United States Patent [19]

Hayashi

[11] Patent Number: 5,063,139

[45] Date of Patent: Nov. 5, 1991

[54] SILVER HALIDE COLOR PHOTOGRAPHIC LIGHT-SENSITIVE MATERIAL CAPABLE OF BEING PROCESSED AT ULTRAHIGH SPEED AND PROCESS FOR THE FORMATION OF COLOR IMAGES USING THEREOF

[75] Inventor: Hiroshi Hayashi, Kanagawa, Japan

[73] Assignee: Fuji Photo Film Co., Ltd., Minami-Ashigara, Japan

[21] Appl. No.: 539,434

[22] Filed: Jun. 15, 1990

[30] Foreign Application Priority Data

Jun. 19, 1989 [JP] Japan ..... 1-156323
Jan. 10, 1990 [JP] Japan ..... 2-003236

[51] Int. Cl.[5] ..... G03C 7/30; G03C 7/32

[52] U.S. Cl. ..... 430/377; 430/496; 430/505; 430/545; 430/551; 430/621; 430/628; 430/642; 430/963

[58] Field of Search ..... 430/545, 505, 496, 642, 430/628, 963, 377

[56] References Cited

U.S. PATENT DOCUMENTS 4,818,667 4/1989 Hamada et al. ..... 430/496
4,833,069 5/1989 Hamada et al. ..... 430/505
4,861,702 8/1989 Suzuki et al. ..... 430/642
4,956,269 9/1990 Ikeda et al. ..... 430/496

*Primary Examiner*—Richard L. Schilling
*Attorney, Agent, or Firm*—Burns, Doane, Swecker & Mathis

[57] ABSTRACT

A color photographic light-sensitive material capable of being processed at an ultrahigh speed, which comprises at least two light-sensitive layers on at least one side of a support wherein each layer contains a light-sensitive silver halide emulsion and a nondiffusive oil-soluble coupler capable of coupling with an oxidation proudct of an aromatic primary amine color developing agent to produce a dye, said light-sensitive layers having different sensitive wavelength ranges, said silver halide is silver chloride or silver chlorobromide containing at least 90 mol % of silver chloride, and the alkali-consuming amount of said light-sensitive material is not more than 2.6 mmol/$m^2$.

A process for the formation of color images using the light-sensitive material, which comprises imagewise exposing light-sensitive material, and then subjecting the material to color development for not more than 20 seconds.

11 Claims, No Drawings

SILVER HALIDE COLOR PHOTOGRAPHIC LIGHT-SENSITIVE MATERIAL CAPABLE OF BEING PROCESSED AT ULTRAHIGH SPEED AND PROCESS FOR THE FORMATION OF COLOR IMAGES USING THEREOF

FIELD OF THE INVENTION

The present invention relates to a silver halide color photographic light-sensitive material and a process for the formation of color images using thereof. More particularly, the present invention relates to a novel color image formation process for forming high quality color prints at ultrahigh speeds.

BACKGROUND OF THE INVENTION

In recent years, high efficiency and high productivity have been required in the processing of color photographic light-sensitive materials. This requirement is particularly acute with regard to the production of color prints. The demand for fast delivery calls for a reduction in print processing time.

The process for finishing color prints involves exposure and color development. The use of high sensitivity light-sensitive materials leads to a reduction in exposure time. In order to reduce color development time, it is essential to use a system in which a light-sensitive material capable of being developed at a high speeds is combined with a particular processing solution or step enabling rapid processing.

One approach for accomplishing this object has been a process wherein a color photographic light-sensitive material having a silver chloride emulsion rather than a silver bromochloride emulsion having a high silver bromide content in color printing light-sensitive materials (hereinafter referred to as "color photographic paper") is processed. For example, International Patent Disclosure W087-04534 describes a process wherein a color photographic light-sensitive material including a silver chloride emulsion is processed with a color developing solution substantially free of sulfurous ions and benzyl alcohol at a high speed.

In addition, JP-A-61-70552 (corresponding to EP 173203; the term "JP-A" as used herein means an "unexamined published Japanese patent application") describes a process wherein a high silver chloride content color photographic material is used, and a developer replenisher is added during development. The replenisher is added in an amount such that it does not overflow into the developing bath. This allows for a reduction in the replenishment rate of the developer. JP-A-63-106655 describes a process which involves processing a color photographic material having a high content of silver chloride, with a color developing solution containing a hydroxylamine compound and a certain amount of chlorine ions which is more than a predetermined concentration, for the purpose of stabilizing processing.

Thus, using a high silver chloride content emulsion, or certain developing solutions, has lead to a reduction in development time, i.e., from 210 seconds (e.g., color development CP-20, available from Fuji Photo Film Co., Ltd.) to 45 seconds (e.g., color development CP-40FAS, available from Fuji Photo Film Co., Ltd. (totaling 360 seconds)). However, these approaches are still undesirable with regard to total processing time relative to other color printing processes (e.g., static transfer process, heat transfer process, inject jet process).

Accordingly, it is desirable to provide a silver halide color photographic material suitable for ultrahigh processing which can be color developed within 20 seconds. This would provide high picture quality color prints at low cost, as well as a drastic reduction in total processing time.

Other approaches for rapid processing (other than the aforementioned emulsion designs) have also been studied. In particular, there have been many proposals for reducing the development time to 180 seconds or less in silver bromochloride emulsion systems. For example, JP-A-63-38937, JP-A-63-40144, JP-A-63-146039, JP-A-61-286855, JP-A-61-289350, and JP-A-61-286854 propose controlling swelling thickness of the light-sensitive material due to the processing solution, or using certain developing agents, and JP-A-63-38937, JP-A-63-40144 and JP-A-63-146039 propose controlling the gelatin coating thickness.

However, color photographs having satisfactorily high picture quality have not yet to be obtained at color development times of 20 seconds or less with these techniques.

SUMMARY OF THE INVENTION

It is therefore an object of the present invention to provide a process for forming high quality color images using a rapid development process; i.e., 20 seconds or less.

It is another object of the present invention to provide a silver halide color photographic material which provides a substantial reduction in total processing time, yet be comparable to other color process recording materials with respect to picture quality and processing time.

These and other objects of the present invention will become more apparent form the following detailed description and examples.

As a result of intensive studies, the inventors have found that the objects of the invention can be effectively attained by limiting the "alkali-consuming amount" of the light-sensitive material to 2.6 mmol/m$^2$. This is a novel concept, one which has never been documented in the prior art. It was also found that the objects of the present invention can be even more effectively accomplished by using a high silver chloride content emulsion, and limiting the total amount of hydrophilic colloids in the light-sensitive material to 2.0 to 8.0 g/m$^2$.

These objects of the present invention are accomplished with a color photographic light-sensitive material capable of being processed at an ultrahigh speed which comprises on at least one side of a support, at least two light-sensitive layers containing a light-sensitive silver halide emulsion and a non diffusive oil-soluble coupler which undergoes coupling with an oxidation product of an aromatic primary amine color developing agent to produce a dye. The light-sensitive layers are sensitive to different wavelength ranges, silver halide in the light sensitive silver halide emulsion is silver chloride or silver chlorobromide containing 90 mol % or more of silver chloride, and the alkali-consuming amount of the photographic light-sensitive material is 2.6 mmol/m$^2$ or less.

In a preferred embodiment, the total solid content of hydrophilic colloid to be contained in the photographic material ranges from 2.0 to 8.0 g/m$^2$.

Further preferred embodiment is that the weight ratio of (high boiling point organic solvent plus other non-binding material)/gelatin solid content in a light-insensitive interlayer in said light-sensitive material is in the range of from 0.6 to 1.3 and said interlayer contains at least one hydrophilic polymer other than gelatin in an amount of 30% by weight or more based on the gelatin (solid content).

In another embodiment, there is provided a process for the formation of color images. The process comprises the imagewise exposure of the aforementioned color photographic light-sensitive material, and then subjecting the material to color development for 20 seconds or less.

DETAILED DESCRIPTION OF THE PREFERRED EMBODIMENT OF THE INVENTION

In general, the development of a color photographic paper comprises; (1) the penetration of a developing solution into a film, (2) the swelling of a light-sensitive material film, (3) the diffusion of an alkali into the film, (4) the diffusion of a developing agent, or the like, into the film, and (5) the development of silver halide. The development further influenced by coloring speed of a coupler, and penetration of a developing agent into an oil, or the like. However, these steps do not occur at the very beginning of the development.

With prior art silver bromochloride emulsions (e.g., Color Paper Processing System CP-20 (development time: 210 seconds) available from Fuji Photo Film Co., Ltd.), the development reaction of silver halide occurs after steps (1), (2), (3) and (4), above, substantially reach equilibrium. This is because that silver bromochloride has an induction period (the time that passes until development begins), and step (5) is a rate-determining step. If the step (5) is carried out at a higher rate, e.g., by using a high silver chloride content emulsion, step (5) is no longer a rate-determining step. One of the other steps becomes the rate-determining step. If the development time falls below 20 seconds, steps (2), (3) and (4) have a greater impact on the rate. The inventors' studies using Fuji Color Paper Super FA and CP40FAS Processing System, available from Fuji Photo Film Co., Ltd., confirm this observation. After the beginning of the development process, equilibrium in step (2) is reached in 15 to 20 seconds. It takes 5 to 6 seconds for an alkali to be supplied to the lowermost layer in step (3). In step (4), it takes as much as 7 to 8 seconds for a developing agent to be supplied to the lowermost layer. The development of the lowermost layer does not begin before about 10 seconds have passed. Even if the development processing is completed in 20 seconds, about 10 seconds of that time is not used for development reaction.

From this point of view, increasing the rate of steps (1), (2), (3) and (4), especially steps (2), (3) and (4), is essential to development which must be completed in 20 seconds or less.

If the development reaction is thoroughly expedited, the supply of a developing agent (which is affected by steps (1) to (4)), or the rise in the pH value of the film (which is affected by step (3) and the alkali-consuming), becomes a rate-determining step.

If controlling the amount of gelatin is employed in combination with a silver chlorobromide emulsion (which is not a high silver chloride content emulsion), it would be expected that many difficulties must be overcome to form images in 20 seconds or less even if the alkali-consuming amount is controlled to be 2.6 mmol/m$^2$ or less, and that it would be difficult to obtain the objects of the present invention. In order to attain the object of the present invention using such a photographic material further reduction of gelatin is necessary. Since the total time for development of such a photographic material is long, even if the time of the start of the development delays in some extent, it was not noticed. Therefore, the relationship between ultra-high speed developing process and the alkali-consuming amount and control of the gelatin amount has not been made clear. As can be seen hereinafter, controlling the amount of gelatin to be used was found to have an unexpectedly great effect according to the present invention.

In the present invention, since development time is short, a reduction in the time required for dispersion of a developing solution into the film is a major factor for the desired improvement. The dispersion of the developing solution, particularly a developing agent, first requires the dispersion of an alkali. An alkali penetrates into the film while undergoing reaction with acidic groups contained in gelatin. Due to the pH buffer action by gelatin, the development requires a large amount of time. In prior art processing, however, development normally takes about 100 seconds. Thus, even if there is some delay in dispersion, the development reaction proceeds while the solution is thoroughly actively exchanged between the inside and the outside (in the developing solution) of the film. Therefore, the pH buffer action of gelatin has little effect on the development reaction. The present invention was discovered based on a new concept addressing the above view.

According to the present invention, the "alkali-consuming amount" is determined and calculated by the following measurement method.

In order to calculate the "alkali-consuming amount", a predetermined area (i.e., 1 m$^2$) of a light-sensitive material is sampled. The coated layers at the side of the support whereon light-sensitive layers are coated, of the test piece is peeled from the support. In general, the support is a polyethylene-laminated paper which can be easily separated from the coated layer. The coated layer side of the test piece is then finely crushed and dispersed in a predetermined amount (i.e., 100 ml) of water. The aqueous solution is then titrated (at about 25° C.) with an aqueous solution of alkali (i.e., 0.1 N potassium hydroxide solution) at about 30 to 60 minutes after the dispersion. The amount of potassium hydroxide in mmol required to attain a pH value of 10.0 from 6.0 is defined as "alkali-consuming amount".

If the support contains an acid component and cannot be separated from the coated layer, the evaluation of the consumed amount of alkali can be accomplished by substracting that of the support from that of the sampled piece.

The alkali-consuming amount gives an evaluation of the acid content in the light-sensitive material and the buffer action thereof. The value is affected by gelatin, which is a hydrophilic binder in the light-sensitive material, or other organic compounds.

In the present invention, if the alkali-consuming amount exceeds a certain value, the high alkalinity at the initial stage of the development cannot be maintained, causing a delay in the development which makes it impossible to accomplish the objects of the present invention. Therefore, if rapid processing is intended, the amount of alkali consumed by the light-sensitive material is a relatively important parameter in accelerating initial development.

In order to reduce the "alkali-consuming amount", which characterizes the present invention, the following approaches are preferably used.

First, the amount of a hydrophilic colloid containing acidic groups to be contained in the light-sensitive material layer may be reduced.

Gelatin is most preferably used as the hydrophilic colloid to be incorporated in the color photographic light-sensitive material comprising a silver halide emulsion as light sensor. However, due to its functional groups, gelatin is capable of pH buffering the penetration of an alkaline solution.

Of course, decreasing the buffering capability is essential to the expedition of the initial development in the rapid processing. Therefore, it is preferable to reduce the amount of gelatin to be incorporated in the light-sensitive material.

Second, it is likely that if the reduction of the amount of gelatin alone is conducted, there is possibility that the physical properties of the film will deteriorate. Therefore, if the amount of gelatin is reduced, a hydrophilic polymer free of acidic functional groups be employed.

As the content of gelatin decreases, the weight proportion of the high boiling point organic solvent (oil) plus the non-binding material to the gelatin (solid content) in the film increases. The term "non-binding material" as used herein means an additive such as a coupler, an ultraviolet absorbing agent, and a development inhibitor (e.g., hydroquinone derivative), excluding gelatin and other hydrophilic polymers. It has heretofore been known that when the content of gelatin decreases, oil-soluble components become easily movable and gelatin cannot easily serve as binder, causing destruction of the film. In particular, the migration of substances and the destruction of the film have a great effect on the interlayer. Undesirable migration of development inhibitor or sensitizing dye in the light-sensitive material prior to processing causes some phenomena such as color stain and reduction in color image density.

It is preferred that the weight ratio of (high boiling point organic solvent plus other non-binding material)-/gelatin solid content in a light-insensitive interlayer in said light-sensitive material is in the range of from 0.6 to 1.3 and said interlayer contains at least one hydrophilic polymer other than gelatin in an amount of 30% by weight or more based on the gelatin (solid content).

When the weight ratio of (oil plus non-binding material)/gelatin falls below 0.6, the film quality has little or no such problems, but the development proceeds slowly, making it impossible to attain the object of the present invention, i.e. ultrahigh speed processing. On the contrary, when this ratio exceeds 1.3, the film quality cannot be improved even if a hydrophilic polymer (other than gelatin) is added. When such a hydrophilic polymer is further added, some improvement is given to the film quality, but the formation of image is retarded, making it impossible to attain the main object of the present invention. Thus, the commercial value of the product cannot be improved as a whole.

The ratio of (oil plus non-binding material)/ gelatin is preferably in the range of from 0.8 to 1.2, more preferably 0.9 to 1.1.

Examples of the hydrophilic polymer other than gelatin which can be used in the present invention include those exemplified hereinafter. Particularly preferred among these hydrophilic polymers are polyacrylamide, polydextran, and polyvinyl alcohol.

The hydrophilic polymer is preferably contained in an amount of at least 30% by weight, more preferably at least 40% by weight, and preferably not more than 70% by weight, based on the weight of gelatin (solid).

Third, the type of gelatin (or derivatives thereof) to be used as the hydrophilic colloid may be altered. In particular, gelatin obtained by altering the treating method during the preparation thereof or esterified or amidized gelatin containing less acidic groups, may be used to alter the number of functional groups, and the isoelctric point, making it possible to reduce the alkali-consuming amount.

Fourth, the amount of organic compounds (which consumes alkali) other than the hydrophilic colloid to be incorporated in the light-sensitive material (e.g., coupler, hydroquinone, phenolic compounds) may be reduced. If this approach is used in combination with a film hardening agent, a light-sensitive material which exhibits a high initial swelling rate can be formed.

Fifth, the alkali-consuming amount may be reduced by controlling the value of pKa of the organic compounds mentioned in the fourth method.

It is would seem likely that the objects of the present invention could be accomplished by increasing the amount of alkali in the processing solution, rather than reducing the amount of alkali consumed by the light-sensitive material. As a result of the inventors' studies, however, it was found that the objects of the present invention cannot be accomplished in this manner.

The amount of the solution which can penetrate into the light-sensitive material layer is very small compared to the amount of an alkali contained in the processing solution. If the amount of alkali contained in the processing solution is increased a relatively poor efficiency is obtained due to the instability of the processing solution. Also, there can inherent safety concerns (possible accidents) when the amount of alkali increased.

Increasing the amount of alkali in the processing solution also causes a rise in the swelling thickness of the light-sensitive material upon development. This increases the amount of developing agent which is incorporated therein. If too much developing agent is incorporated into the light-sensitive material, it retards the effective removal of the developing agent in the subsequent rinse step, causing staining.

Increasing the amount of alkali in the processing solution will also cause some deterioration in the physical properties of the film of the light-sensitive material, particularly film strength upon swelling during and after processing.

Therefore, it is essential to reduce the "amount of alkali" consumed by the light-sensitive material to accomplish the objects of the present invention. The consumed amount of alkali is preferably in the range of 1.82 mmol/$m^2$ or less.

The color photographic light-sensitive material according to the present invention may comprise a support having coated thereon at least one blue-sensitive silver halide emulsion layer, at least one green-sensitive silver halide emulsion layer and at least one red-sensitive silver halide emulsion layer. In the case of conventional color printing papers, the light-sensitive layers are usually provided on a support in the order as described above, but they can also be provided in a different order. Further, an infrared-sensitive silver halide emulsion layer may be employed in place of at least one of the above described emulsion layers. Each of the light-sensitive emulsion layers contains a silver halide emulsion having sensitivity in a respective wavelength region and a so-called color coupler which forms a dye of the complementary color to the light to which the silver halide emulsion is sensitive, that is, yellow, magenta and cyan to blue, green and red, respectively. Thus, color reproduction by a subtractive process can be performed. However, the relationship of the light-sensitive layer and hue of dye formed from the coupler may be varied in a different way from that described above.

The halogen composition may be equal or different between individual grains in the emulsion. When an emulsion having an equal halogen composition between individual grains is used, it is easy to uniformly control the properties of the grains. Further, with respect to the distribution of the halogen composition inside the silver halide emulsion grains, grains having a so-called "uniform structure" wherein the halogen composition is equal at any portion of the grains, grains having a so-called "stratified structure" wherein the halogen composition of the interior (i.e., core) of grain is different from that of the shell (which includes one or more layers) surrounding the core, and grains having a structure wherein portions having different halogen compositions are present in the non-stratified form in the interior or on the surface of grains (i.e., the portion having a different composition being junctioned at an edge, corner or plane of the surface) can be appropriately selected. In order to obtain high sensitivity, it is advantageous to employ any of the two latter type grains rather than the uniform structure grains. They are also preferred in view of their resistance to pressure. In a case wherein silver halide grains have the different structures described above, the boundary of portions having different halogen compositions from each other may be either distinct or vague because of the formation of a mixed crystal due to the composition difference. Further, grains having an intentionally continuous change in structure may also be employed.

In photographic light-sensitive materials of the present invention suitable for rapid processing, a so-called "high silver chloride content emulsion" which has a high silver chloride content ratio is preferably used. The silver chloride content ratio in a high silver chloride content emulsion is preferably 90 mol % or more, more preferably 95 mol % or more.

Of such high silver chloride content emulsions, those having a structure wherein a localized phase of silver bromide is present in the interior and/or on the surface of silver halide grains in the stratified form or in the non-stratified form as described above are preferred. With respect to the halogen composition of the localized phase described above, it is preferred that the silver bromide content is at least 10 mol %, and more preferably exceeding 20 mol %. The localized phase may exist in the interior of the grain, or at the edge, corner or plane of the surface of the grain. One preferred example is a grain wherein epitaxial growth is made at the corner.

On the other hand, for the purpose of minimizing the reduction in sensitivity which occurs when pressure is applied to the photographic light-sensitive material, it is also preferred to use uniform structure type grains, having a narrow distribution of the halogen composition even in a high silver chloride content emulsion having a silver chloride content of 90 mol % or more.

Further, for the purpose of reducing the amount of replenisher for a developing solution, the silver chloride content of a silver halide emulsion may be further increased. In such a case, an almost pure silver chloride is one wherein the silver chloride content is from 98 mol % to 100 mol %.

The average grain size of silver halide grains in the silver halide emulsion used in the present invention (the grain size being defined as a diameter of a circle having the same area as the projected area of the grain and being averaged by number) is preferably from 0.1 μm to 2 μm.

Moreover, it is preferred to employ a so-called monodispersed emulsion which has a grain size distribution such that the coefficient of variation (obtained by dividing the standard deviation of the grain size distribution with the average grain size) is not more than 20%, particularly not more than 15%. Further, it is preferred to employ two or more of the above described monodispersed emulsions as a mixture in the same layer or in the form of superimposed layers in order to obtain a wide latitude.

The silver halide grains contained in the photographic emulsion may have a regular crystal shape such as cubic, tetradecahedral, octahedral, etc., or an irregular crystal shape such as spherical, tabular, etc., or may have a composite form of these crystal shapes. Also, a mixture of grains having various crystal shapes may be used. Of these emulsions, those containing the grains having the above described regular crystal shape not more than 50%, preferably not more than 70%, and more preferably not more than 90% are advantageously used in the present invention.

Further, a silver halide emulsion wherein tabular silver halide grains having an average aspect ratio (i.e., the diameter of a corresponding circle/ thickness) at least 5, preferably at least 8, accounts for at least 50% of the total projected area of the silver halide grains may be preferably used in the present invention.

The silver halide emulsion used in the present invention can be prepared in any suitable manner, for example, by the methods as described in P. Glafkides, *Chemie et Physique Photographique,* Paul Montel (1967), G. F. Duffin, *Photographic Emulsion Chemistry,* The Focal Press (1966), and V. L. Zelikman et al., *Making and Coating Photographic Emulsion,* The Focal Press (1964). That is, acid processes, neutral processes, and ammonia processes can all be employed.

Soluble silver salts and soluble halogen salts can be reacted by techniques such as a single jet, process, a double jet process, and a combination thereof. In addition, a method (a so-called "reversal mixing process") in which silver halide grains are formed in the presence of an excess of silver ions can also be employed. As one system of the double jet process, a so-called "controlled double jet process" in which the pAg in a liquid phase where silver halide is formed is maintained at a predetermined level can be employed. This process gives a silver halide emulsion in which the crystal form is regular and the grain size is nearly uniform.

During the step of formation or physical ripening of the silver halide grains of the silver halide emulsion used in the present invention, various kinds of multi-valent metal ion impurities can be introduced. Suitable examples of the compounds include cadmium salts, zinc salts, lead salts, copper salts, thallium salts, salts or complex salts of the Group VIII elements, for example, iron, ruthenium, rhodium palladium, osmium, iridium, and platinum. In particular, the above described Group VIII elements are preferably used. The amount of the compound added can be varied over a wide range depending on the purpose, but it is preferably used in a range from $10^{-9}$ to $10^{-2}$ mol per mol of silver halide.

The silver halide emulsions used in the present invention are usually subjected to chemical sensitization and spectral sensitization.

With respect to the chemical sensitization, a sulfur sensitization method (for example, the use of unstable sulfur compound), a noble metal sensitization method (for example, a gold sensitization method), and a reduction sensitization method are employed individually or in a combination. The compounds preferably used in the chemical sensitization include those as described in JP-A-62-215272, page 18, right lower column to page 22, right upper column.

The spectral sensitization is performed in order to impart spectral sensitivity in the desired wavelength range to the emulsion of each layer of the photographic light-sensitive material. According to the present invention, the spectral sensitization is conducted by adding a spectral sensitizing dye which is a dye capable of absorbing light of a wavelength range corresponding to the desired spectral sensitivity. Suitable examples of the spectral sensitizing dyes used include those as described, for example, in F. H. Harmer, *Heterocyclic compounds-Cyanine dyes and related compounds,* John Wiley & Sons (New York, London) (1964). Specific examples of the sensitizing dyes preferably employed are described in JP-A-62-215272, page 22, right upper column to page 38.

The silver halide emulsions used in the present invention can contain various kinds of compounds or precursors thereof for preventing the occurrence of fog or for stabilizing photographic performance during the production, storage and/or photographic processing of photographic light-sensitive materials. Specific examples of the compounds preferably used are described in JP-A-62-215272, page 39 to page 72.

The silver halide emulsion used in the present invention may be a so-called surface latent image type emulsion wherein latent images are formed mainly on the surface of grains or a so-called internal latent image type emulsion wherein latent images are formed mainly in the interior of grains.

If the present invention is applied to color light-sensitive materials, the color light-sensitive materials normally include yellow, magenta and cyan couplers which undergo coupling with an oxidation product of an aromatic amine color developing agent to develop colors.

Cyan, magenta and yellow couplers which are preferably used in the present invention are represented by the general formulae (C-I), (C-II), (M-I), (M-II) and (Y):

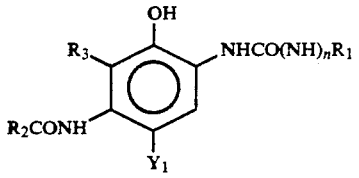

(C-I)

-continued

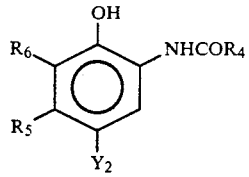

(C-II)

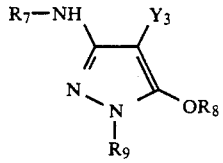

(M-I)

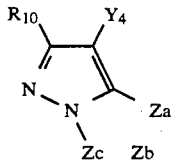

(M-II)

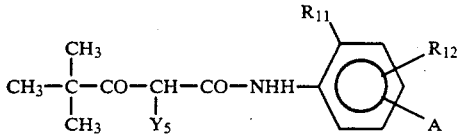

(Y)

In general formulae (C-I) and (C-II), $R_1$, $R_2$ and $R_4$ each represents a substituted or unsubstituted aliphatic, aromatic or heterocyclic group (preferably a 5- to 7-membered ring containing at least one of N, O and S as a hetero atom: the same hereinafter). $R_3$, $R_5$ and $R_6$ each represents a hydrogen atom, halogen atom, aliphatic group, aromatic group or acylamino group (in the present invention an acyl group or an acyl moiety includes an aliphatic and aromatic acyl group or acyl moiety). $R_3$ may represent a nonmetallic atom group which forms a nitrogen-containing 5- or 6-membered ring together with $R_2$. $Y_1$ and $Y_2$ each represents a hydrogen atom or a group capable of being released upon coupling with an oxidation product of a developing agent. The suffix n represents an integer 0 or 1. Each $R_1$, $R_2$, $R_3$ and $R_4$ preferably contains not more than 30 carbon atoms (including carbon atoms in substituent(s)).

The cyan coupler represented by general formula (C-I) or (C-II) will be further described hereinafter.

In general formula (C-I), $R_1$ is preferably an aryl group or heterocyclic group, more preferably aryl group substituted by halogen atom, alkyl group, alkoxy group, aryloxy group, acylamino group, acyl group, carbamoyl group, sulfonamide group, sulfamoyl group, alkyl- or aryl-sulfonyl group, oxycarbonyl group or aryl group substituted with a cyano group.

In general formula (C-I), if $R_3$ and $R_2$ do not together form a ring, $R_2$ is preferably a substituted or unsubstituted alkyl or aryl group, preferably a substituted aryloxy-substituted alkyl group, and $R_3$ is preferably a hydrogen atom.

In general formula (C-II), $R_4$ is preferably a substituted or unsubstituted alkyl or aryl group, preferably a substituted aryloxy-substituted alkyl group.

In general formula (C-II), $R_5$ is preferably a $C_{2-15}$ alkyl group and a substituted methyl group containing 1 or more carbon atoms. Preferred examples of such substituents include arylthio group, alkylthio group, acylamino group, aryloxy group, and alkyloxy group.

In general formula (C-II), $R_5$ is more preferably $C_{2-15}$ alkyl group, particularly $C_{2-4}$ alkyl group.

In general formula (C-II), $R_5$ is preferably an aliphatic group such as methyl group, ethyl group, propyl group, butyl group, pentadecyl group, tert-butyl group, cyclohexyl group, cyclohexylmethyl group, phenylthiomethyl group, dodecyloxyphenylthiomethyl group, butanamidemethyl group and methoxymethyl group.

In general formula (C-II), $R_6$ is preferably a hydrogen atom or halogen atom, particularly chlorine atom or fluorine atom. In general formulae (C-I) and (C-II), $Y_1$ and $Y_2$ each is preferably a hydrogen atom, halogen atom, alkoxy group, aryloxy group, acyloxy group or sulfonamide group.

These cyan couplers may be in the form of a polymer.

In formula (M-I), $R_7$ and $R_9$ each represents an aryl group; $R_8$ represents a hydrogen atom, an aliphatic or aromatic acyl group or an aliphatic or aromatic fonyl group; and $Y_3$ represents a hydrogen atom or a releasing group. $R_7$, $R_8$, and $R_9$ each preferably contains carbon atoms of not more than 40 (including carbon atoms in a substituent(s)).

The aryl group represented by $R_7$ or $R_9$ (preferably a phenyl group) may be substituted with one or more substituents which are selected from the substituents described with respect to $R_1$. When two or more substituents are present, they may be the same or different. $R_8$ is preferably a hydrogen atom, an aliphatic acyl group or an aliphatic sulfonyl group, and more preferably a hydrogen atom. $Y_3$ is preferably a releasing group which is released at any of a sulfur atom, an oxygen atom or a nitrogen atom, and more preferably a releasing group of a sulfur atom releasing type as described, for example, in U.S. Pat. No. 4,351,897 and International Laid Open No. WO 88/04795.

In the general formula (M-II), $R_{10}$ represents a hydrogen atom or a substituent; $Y_4$ represents a hydrogen atom or a releasing group, preferably a halogen atom or an arylthio group; Za, Zb and Zc each represents a methine group, a substituted methine group, =N— or —NH—, wherein one of the Za-Zb bond and the Zb-Zc bond is a double bond and the other is a single bond; when the Zb-Zc bond is a carbon-carbon double bond, the Zb-Zc bond may be a part of a condensed aromatic ring; $R_{10}$ or $Y_4$ may also form a polymer including a dimer or more; and when Za, Zb or Zc is a substituted methine group, the substituted methine group may form a polymer including a dimer or more.

Examples for the substituent represented by $R_{10}$, the substituent for the azole ring, etc., may be those which are disclosed in U.S. Pat. No. 4,540,654, column 2, line 41 to column 8, line 27.

Of the pyrazoloazole type couplers which are represented by formula (M-II), imidazo[1,2-b]pyrazoles as described in U.S. Pat. No. 4,500,630 are preferred and pyrazolo[1,5-b][1,2,4]triazoles as described in U.S. Pat. No. 4,540,654 are particularly preferred in view of the less yellow subsidiary adsorption and light fastness of dyes formed therefrom.

Further, pyrazolotriazole couplers having a branched alkyl group directly connected to the 2, 3 or 6 position of the pyrazolotriazole ring as described in JP-A-61-65245, pyrazoloazole couplers having a sulfonamido group in their molecules as described in JP-A-61-65246, pyrazoloazole couplers having an alkoxyphenylsulfonamido ballast group as described in JP-A-61-147254, and pyrazolotriazole couplers having an alkoxy group or an aryloxy group at the 6 position thereof as described in European Patent (OPI) Nos. 226,849 and 294,785 are also preferably employed.

The above described magenta couplers may be in a form of a polymer.

In the general formula (Y), $R_{11}$ represents a halogen atom, an alkoxy group, a trifluoromethyl group or an aryl group; $R_{12}$ represents a hydrogen atom, a halogen atom or an alkoxy group; A represents —$NHCOR_{13}$, —$NHSO_2R_{13}$, —$SO_2NHR_{13}$, —$COOR_{13}$ or $$-SO_2\underset{\underset{R_{14}}{|}}{N}-R_{13}$$

(wherein $R_{13}$ and $R_{14}$ each represents an alkyl group, an aryl group or an acyl group); and $Y_5$ represents a releasing group.

The group represented by $R_{12}$, $R_{13}$ or $R_{14}$ may be substituted With one or more substituents which are selected from the substituents described with respect to $R_1$. The releasing group represented by $Y_5$ is preferably a releasing group which is released at any of an oxygen atom or a nitrogen atom, and more preferably a releasing group of a nitrogen atom releasing type.

The above-described yellow couplers may be in the form of a polymer.

Specific examples of couplers represented by the general formulae (C-I), (C-II), (M-I), (M-II) and (Y) will be set forth below, but the present invention should not be construed as being limited thereto.

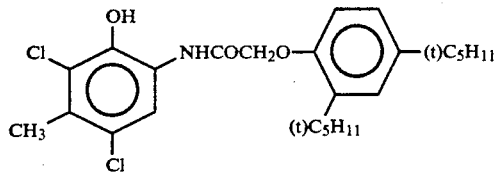

(C-1)

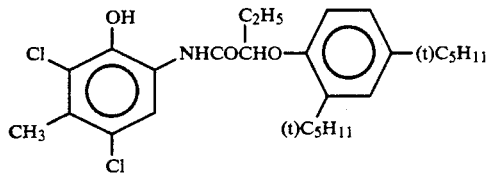

(C-2)

-continued
(C-3)
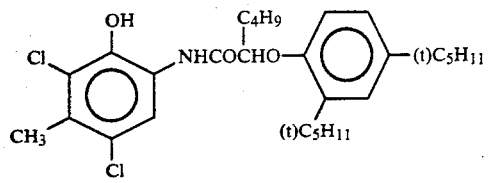
(C-4)
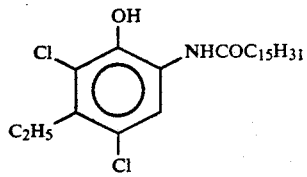
(C-5)
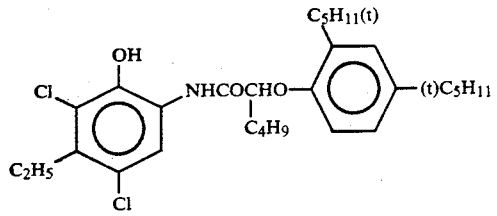
(C-6)
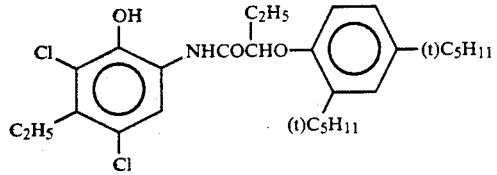
(C-7)
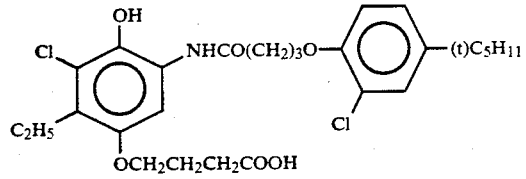
(C-8)
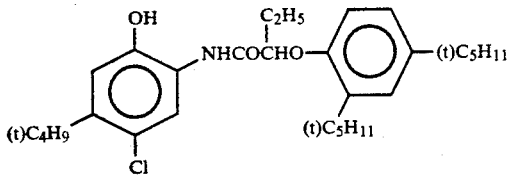
(C-9)
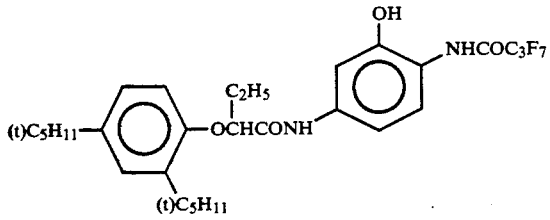
(C-10)
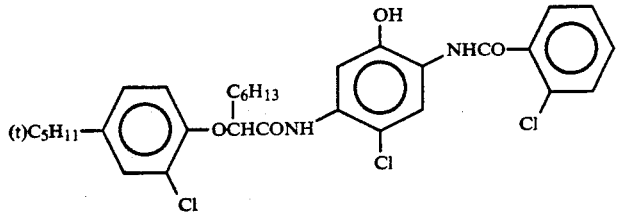

-continued
(C-11)
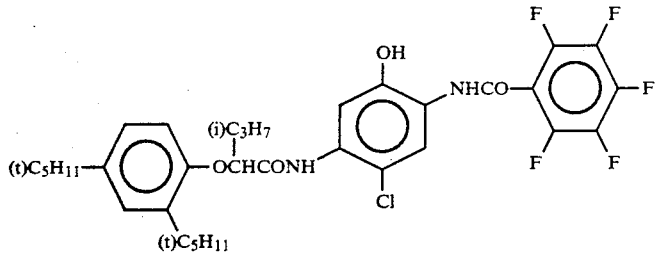
(C-12)
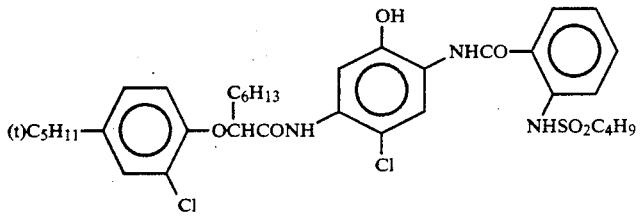
(C-13)
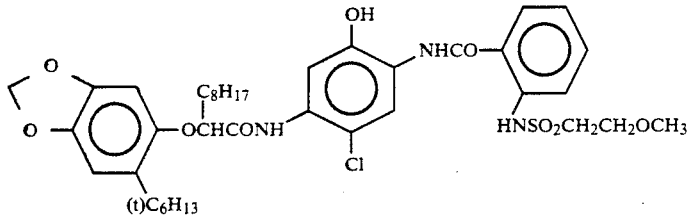
(C-14)
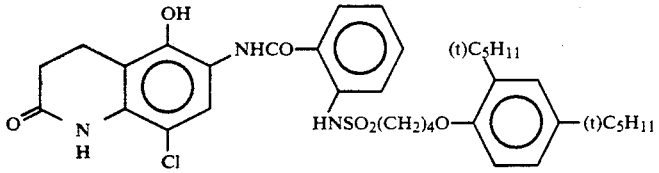
(C-15)
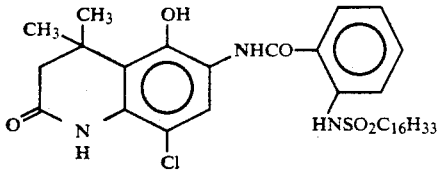
(C-16)
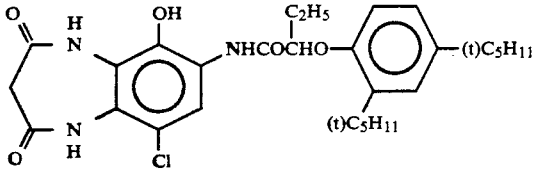
(C-17)
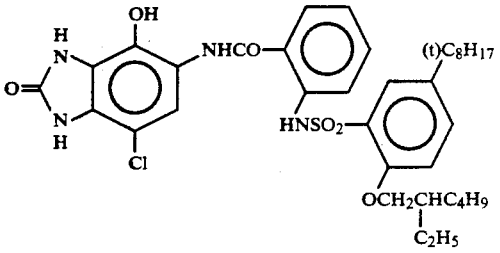

-continued
(C-18)
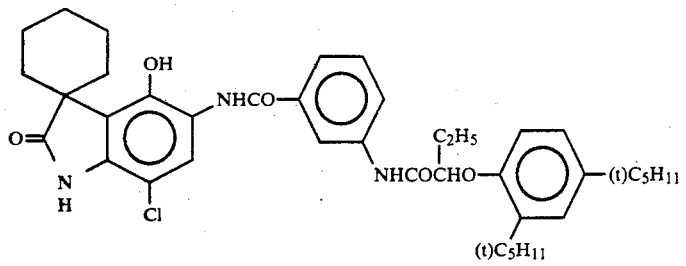
(C-19)
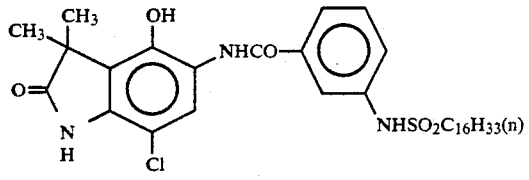
(C-20)
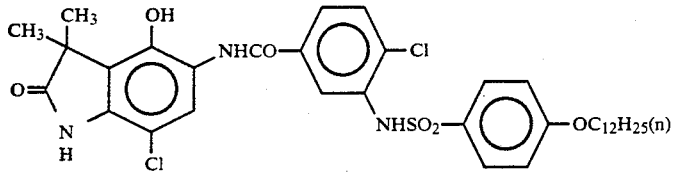
(C-21)
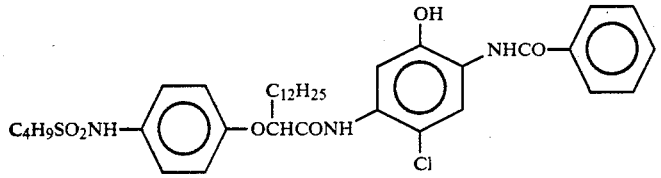
(C-22)
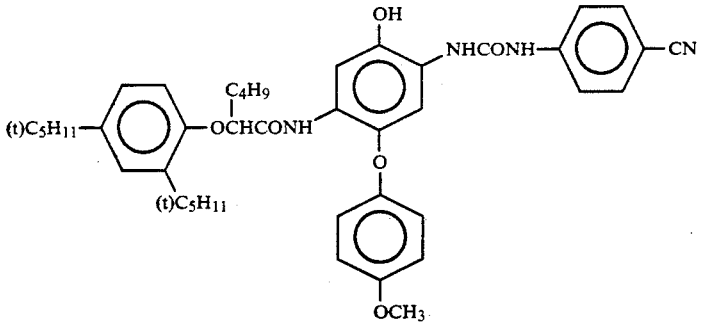
(M-1)
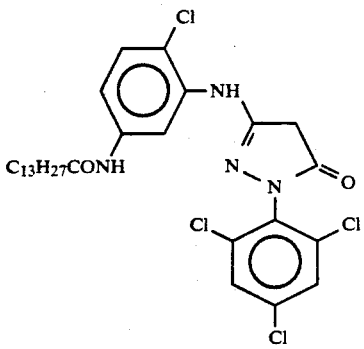

-continued
(M-2)
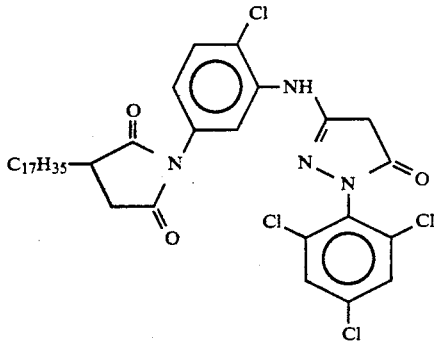
(M-3)
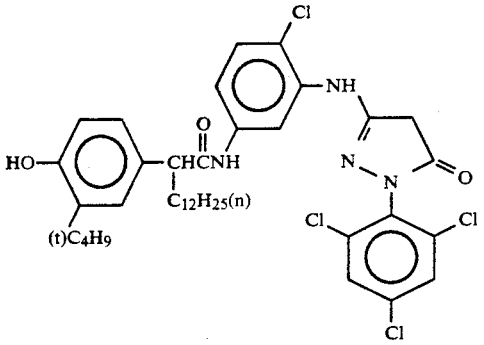
(M-4)
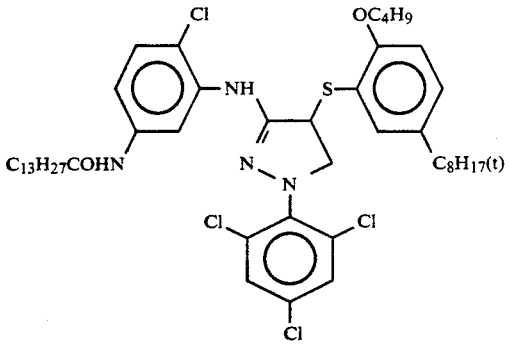
(M-5)
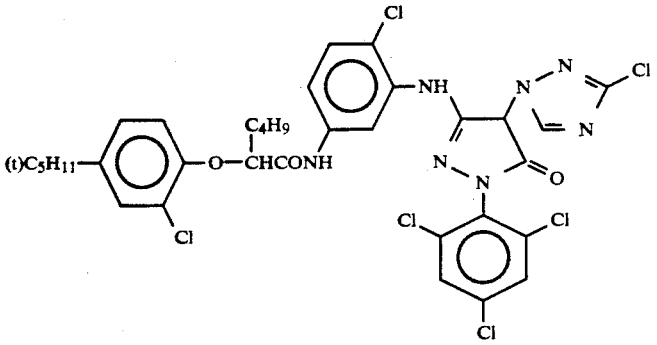

-continued
(M-6)
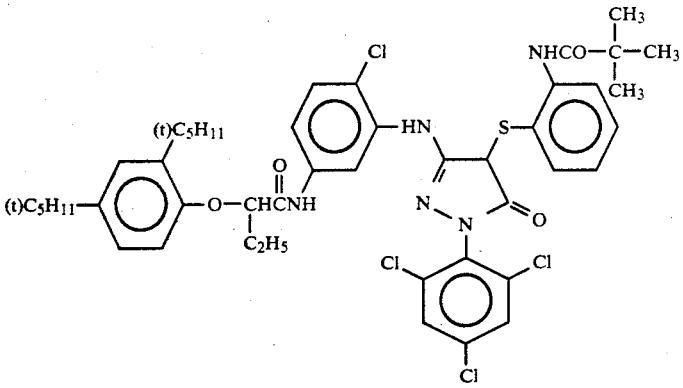
(M-7)
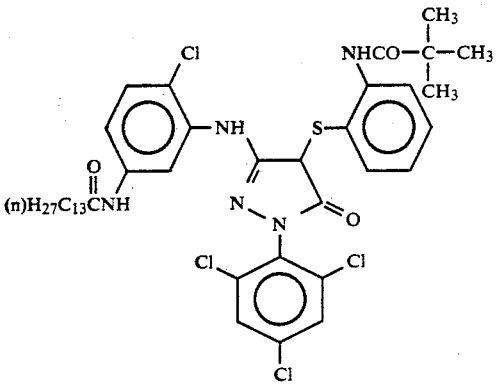
(M-8)
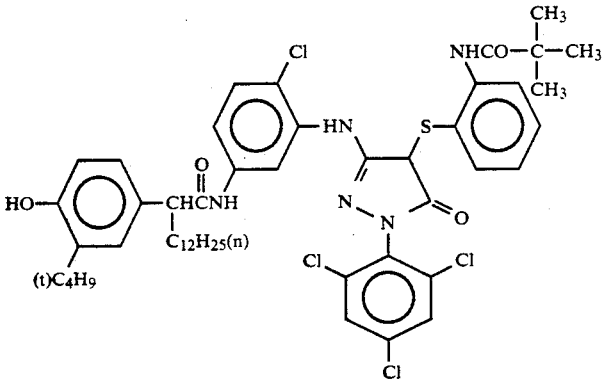
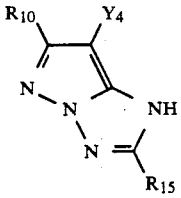
| Compound | $R_{10}$ | $R_{15}$ | $Y_4$ |
|---|---|---|---|
| M-9 | $CH_3$— | 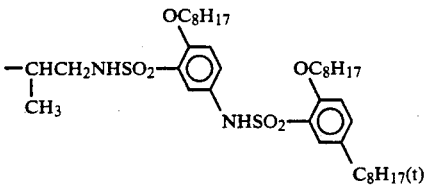 | Cl |

-continued

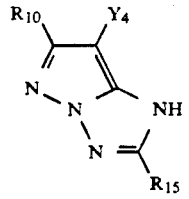

| Compound | $R_{10}$ | $R_{15}$ | $Y_4$ |
|---|---|---|---|
| M-10 | $CH_3$— | $OCH_2CH_2OC_6H_{13}(n)$; —CH($CH_3$)$CH_2NHSO_2$—; $C_8H_{17}(t)$ | Cl |
| M-11 | $(CH_3)_3C$— | $C_5H_{11}(t)$; —CH($CH_3$)$CH_2NHCOCH$($C_2H_5$)O—; $C_5H_{11}(t)$ | —O—$C_6H_4$—$CH_3$ |
| M-12 | $OCH_3$; —O— | $OC_8H_{17}$; —$C_6H_4$—$NHSO_2$—; $C_8H_{17}(t)$ | $OC_4H_9$; —S—; $C_8H_{17}(t)$ |
| M-13 | $CH_3$— | $OC_2H_4OC_2H_5$; —CH($CH_3$)$CH_2NHSO_2$—; $OC_8H_{17}$; $NHSO_2$—; $C_8H_{17}(t)$ | Cl |
| M-14 | $CH_3$— | $C_5H_{11}(t)$; —C($CH_3$)$_2$$CH_2NHCOCH$($C_6H_{13}(n)$)O—; $C_5H_{11}(t)$ | Cl |
| M-15 | $CH_3$— | $C_5H_{11}(t)$; —CH($CH_3$)$CH_2NHCOCH$($C_6H_{13}(n)$)O—; $C_5H_{11}(t)$ | Cl |
| M-16 | $CH_3$— | $OC_{12}H_{25}(n)$; —CH($CH_3$)$CH_2NHSO$— | Cl |
| M-17 | $CH_3$— | $OC_{16}H_{33}(n)$; —CH($CH_3$)$CH_2NHCO$— | Cl |
| M-18 | —$C_6H_4$—$OCH_2CH_2O$— | $OCH_3$; O; —$C_6H_4$—$CH_2CH_2NHSO_2$—; $OC_8H_{17}$; $NHSO_2$—; $C_8H_{17}(t)$ | $OC_4H_9$; —S—; $C_8H_{17}(t)$ |
| M-19 | $CH_3CH_2O$— | as above | as above |

-continued
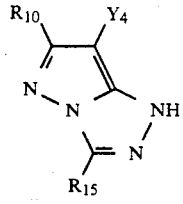
| Compound | $R_{10}$ | $R_{15}$ | $Y_4$ |
|---|---|---|---|
| M-20 | 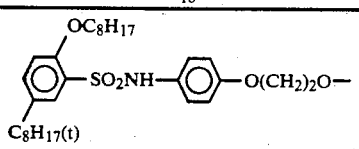 | 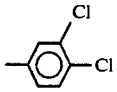 | 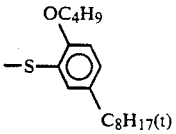 |
| M-21 | 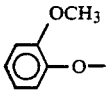 | 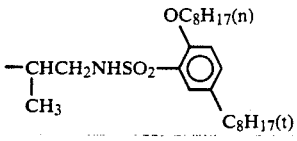 | Cl |
| M-22 | $CH_3$— | 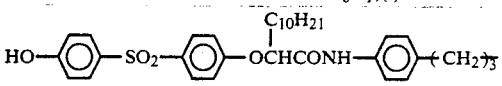 | Cl |
| M-23 | $CH_3$— | 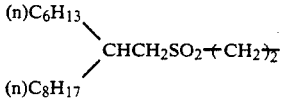 | Cl |
| M-24 | 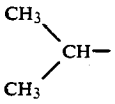 | 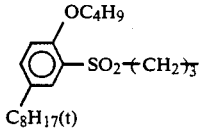 | Cl |
| M-25 | 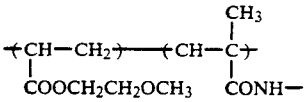 | 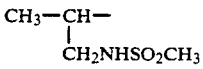 | Cl |
| M-26 | 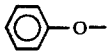 | 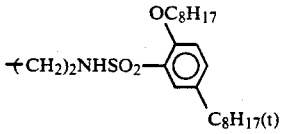 | Cl |
| M-27 | $CH_3$— | 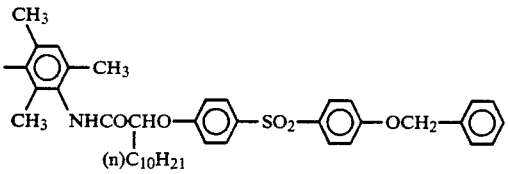 | Cl |
| M-28 | $(CH_3)_3C$— | 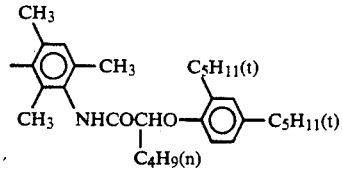 | Cl |
| M-29 | 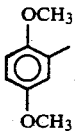 | 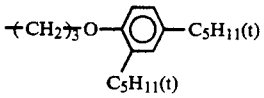 | Cl |
| M-30 | $CH_3$— | 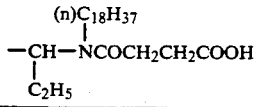 | Cl |
(Suffixes of parenthesis show weight ratio.)

(Y-1)
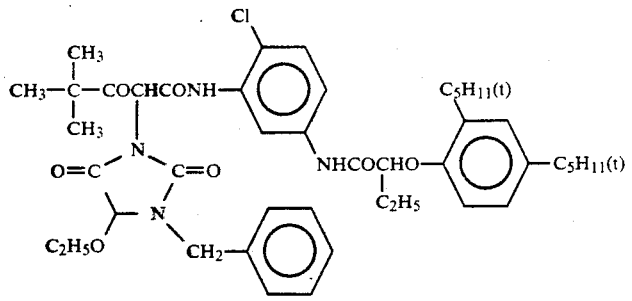
(Y-2)
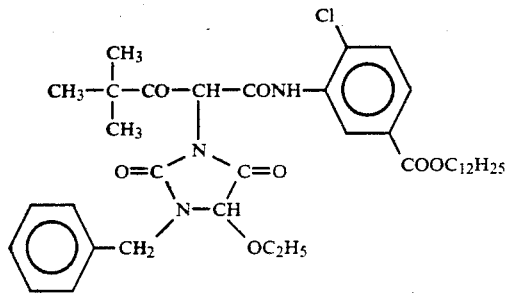
(Y-3)
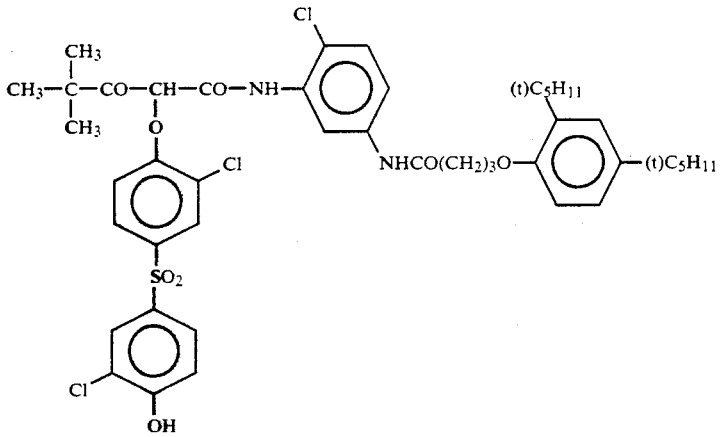
(Y-4)
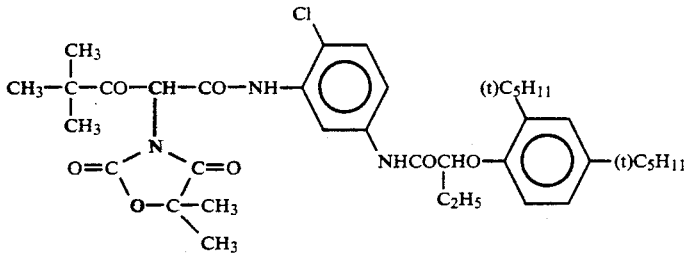
(Y-5)
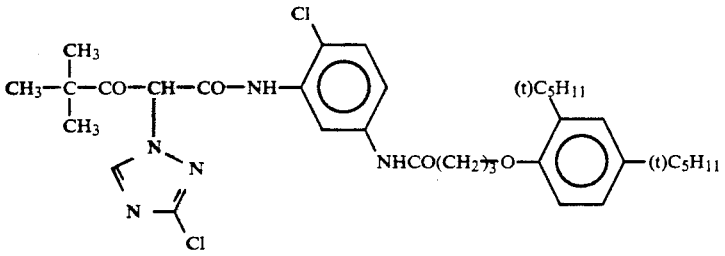

-continued (Y-6)

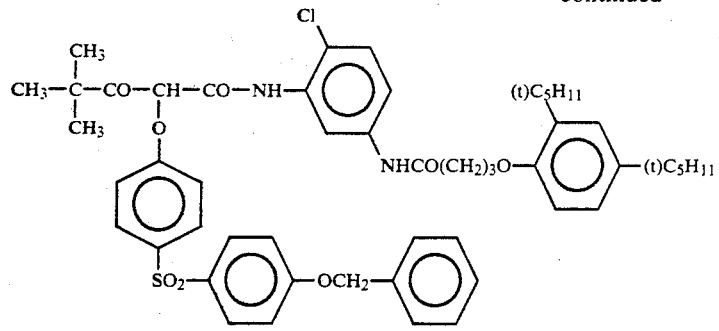

(Y-7)

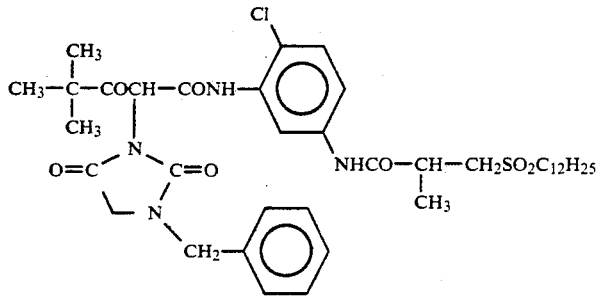

(Y-8)

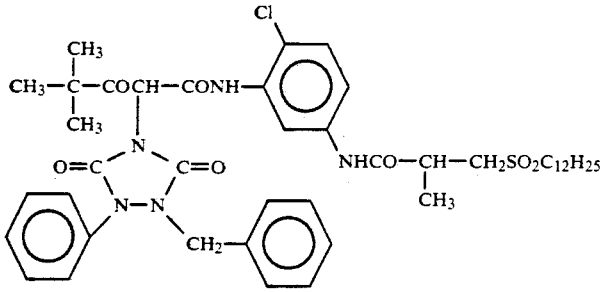

(Y-9)

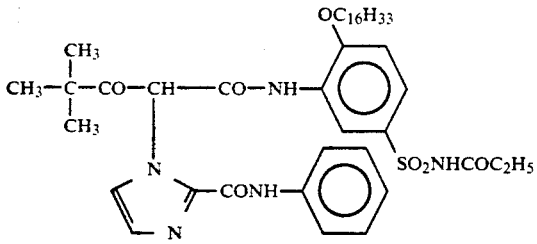

The coupler represented by formula (C-I) to (Y) described above is incorporated into a silver halide emulsion layer which forms a light-sensitive layer in an amount ranging generally from 0.1 to 1.0 mole, preferably from 0.1 to 0.5 mole, per mole of silver halide.

In the present invention, the above-described couplers, may be added to light-sensitive silver halide emulsion layers by applying various known techniques. Usually, they can be added according to an oil-droplet-in-water dispersion method known as an oil protected process. For example, couplers are first dissolved in a solvent, and then emulsified and dispersed in a gelatin aqueous solution containing a surface active agent. Alternatively, water or a gelatin aqueous solution may be added to a coupler solution containing a surface active agent, followed by phase inversion to obtain an oil-droplet-in-water dispersion. Further, alkali-soluble couplers may also be dispersed according to a so-called Fischer's dispersion process. The coupler dispersion may be subjected to distillation, noodle washing, ultrafiltration, or the like to remove an organic solvent having a low boiling point and then mixed with a photographic emulsion.

As the dispersion medium of the couplers, an organic solvent having a high boiling point which has a dielectric constant of 2 to 20 (at 25° C.) and a refractive index of 1.5 to 1.7 (at 25° C.) and/or a water-insoluble polymer compound is preferably employed.

Preferred examples of the organic solvent having a high boiling point used in the present invention include those represented by the following general formula (A), (B), (C), (D) or (E):

(A)

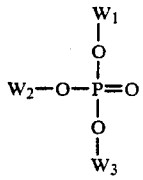

-continued $W_1—COO—W_2$ (B)

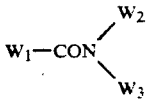
(C)

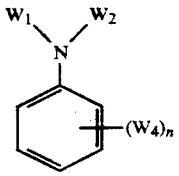
(D)

$W_1—O—W_2$ (E)

wherein $W_1$, $W_2$ and $W_3$ each represents a substituted or unsubstituted alkyl group, a substituted or unsubstituted cycloalkyl group, a substituted or unsubstituted alkenyl group, a substituted or unsubstituted aryl group or a substituted or unsubstituted heterocyclic group; $W_4$ represents $W_1$, $—O—W_1$ or $—S—W_1$; n represents an integer from 1 to 5, and when n is two or more, two or more $W_4$'s may be the same or different. In addition, $W_1$ and $W_2$ in formula (E) may form a condensed ring.

In addition to the solvents represented by formulae (A) to (E), any compound which has a melting point of 100° C. or lower and a boiling point of 140° C. or higher and which is immiscible with water and a good solvent for the coupler may be utilized as the high boiling point solvent in the present invention. The melting point of the organic solvent having a high boiling point is preferably not more than 80° C. The boiling point of the organic solvent having a high boiling point is preferably not less than 160° C., more preferably not less than 170° C.

Organic solvents having a high boiling point are described in detail in JP-A-62-215272, page 137, right lower column to page 144, right upper column.

Further, these couplers can be emulsified and dispersed in an aqueous solution of a hydrophilic colloid by loading them into a loadable latex polymer (such as those described in U.S. Pat. No. 4,203,716) in the presence of or in the absence of the above described organic solvent having a high boiling point, or dissolving them in a water-insoluble and organic solvent-soluble polymer.

Suitable examples of the polymers include homopolymers and copolymers as described in International Laid Open No. WO 88/00723, pages 12 to 30. In particular, acrylamide polymers are preferably used in view of improved color image stability.

The color photographic light-sensitive material according to the present invention may also contain a hydroquinone derivative, an aminophenol derivative, a gallic acid derivative, or an ascorbic acid derivative, as a color fog preventing agent.

In the color photographic light-sensitive material according to the present invention, various color fading preventing agents can be employed. More specifically, representative examples of organic color fading preventing agents for cyan, magenta and/or yellow images include hindered phenols (for example, hydroquinones, 6-hydroxychromans, 5-hydroxycoumarans, spirochromans, p-alkoxyphenols, or bisphenols), gallic acid derivatives, methylenedioxybenzenes, aminophenols, hindered amines, or ether or ester derivatives thereof derived from each of these compounds by sililation or alkylation of the phenolic hydroxy group thereof. Further, metal complexes representatively illustrated by (bissalicylaldoxymate) nickel complex and (bis-N,N-dialkyldithiocarbamate) nickel complexes may be employed.

Specific examples of the organic color fading preventing agents are described in the following patents or patent applications.

Hydroquinones: U.S. Pat. Nos. 2,360,290, 2,418,613, 2,700,453, 2,701,197, 2,728,659, 2,732,300, 2,735,765, 3,982,944 and 4,430,425, British Patent 1,363,921, U.S. Pat. Nos. 2,710,801 and 2,816,028; 6-hydroxychromanes, 5-hydroxycoumarans and spirochromanes: U.S. Pat. Nos. 3,432,300, 3,573,050, 3,574,627, 3,698,909 and 3,764,337, JP-A-52-152225; spiroindanes: U.S. Pat. No. 4,360,589; p-alkoxyphenols: U.S. Pat. No. 2,735,765, British Patent 2,066,975, JP-A-59-10539, JP-B-57-19765; hindered phenols: U.S. Pat. No. 3,700,455, JP-A-52-72224, U.S. Pat. No. 4,228,235, JP-B-52-6623; gallic acid derivatives, methylenedioxybenzenes and aminophenols: U.S. Pat. Nos. 3,457,079 and 4,332,886, JP-B-56-21144; hindered amines: U.S. Pat. Nos. 3,336,135 and 4,268,593, British Patents 1,326,889, 1,354,313 and 1,410,846, JP-B-51-1420, JP-A-58-114036, JP-A-59-53846, JP-A-59-78344.

Further, specific examples of the metal complexes are described in U.S. Pat. Nos. 4,050,938 and 4,241,155, and British Patent 2,027,731(A).

The color fading preventing agent is co-emulsified with the corresponding color coupler in an amount of from 5 to 100% by weight of the color coupler and incorporated into the light-sensitive layer to achieve the effects thereof.

In order to prevent the degradation of the cyan dye image due to heat and particularly due to light, an ultraviolet light absorbing agent is introduced into a cyan color forming layer and/or both layers adjacent to the cyan color forming layer.

Suitable examples of the ultraviolet light absorbing agents used include aryl group-substituted benzotriazole compounds (for example, those as described in U S. Pat. No. 3,533,794), 4-thiazolidone compounds (for example, those as described in U.S. Pat. Nos. 3,314,794 and 3,352,681), benzophenone compounds (for example, those as described in JP-A-46-2784), cinnamic acid ester compounds (for example, those as described in U.S. Pat. Nos. 3,705,805 and 3,707,395), butadiene compounds (for example, those as described in U.S. Pat. No. 4,045,229), and benzoxydole compounds (for example, those as described in U.S. Pat. Nos. 3,406,070, 3,677,672 and 4,271,307). Furthermore, ultraviolet light absorptive couplers (for example, α-naphtholic cyan dye forming couplers) or ultraviolet light absorptive polymers may be used as ultraviolet light absorbing agents. These ultraviolet light absorbing agents may be mordanted in a specific layer.

Among these ultraviolet light absorbing agents, the aryl group-substituted benzotriazole compounds described above are preferred.

In accordance with the present invention, it is preferred to employ the compounds as described below together with the above described couplers, particularly the pyrazoloazole couplers. More specifically, a compound (F) which is capable of forming a chemical bond with the aromatic amine developing agent remaining after color development to give a chemically inactive and substantially colorless compound and/or a compound (G) which is capable of forming a chemical bond with the oxidation product of the aromatic amine developing agent remaining after color development to give a chemically inactive and substantially colorless compound are preferably employed in order to prevent the occurrence of stain and other undesirable side-effects due to the formation of colored dye upon a reaction of the color developing agent or oxidation product thereof which remains in the photographic layer with the coupler during preservation of the photographic material after processing. The compounds (F) and (G) may be employed individually or in combination.

Among the compounds (F), those capable of reacting at a second order reaction rate constant $k_2$ (in trioctyl phosphate at 80° C.) with p-anisidine of from 1.0 liter/mol.sec. to $1\times10^{-5}$ liter/mol.sec. are preferred. The second order reaction rate constant can be measured by a method such as that described in JP-A-63-158545.

When the constant $k_2$ is larger than the upper limit of this range, the compounds per se are unstable and may apt to react with gelatin or water to decompose. On the other hand, when the constant $k_2$ is smaller than the lower limit of the above described range, the reaction rate in the reaction with the remaining aromatic amine developing agent is low, and as a result, the degree of prevention of the side-effect due to the remaining aromatic amine developing agent, tends to be reduced.

Of the Compounds (F), more preferred are those represented by the following general formula (FI) or (FII):

$$R_1-(A)_n-X \qquad \text{(FI)}$$

$$R_2-\underset{\underset{B}{|}}{C}=Y \qquad \text{(FII)}$$

wherein $R_1$ and $R_2$ each represents an aliphatic group, an aromatic group or a hetrocyclic group; n represents 0 or 1; A represents a group capable of reactin with an aromatic amine developing agent to form a chemical bond; X represents a group capable of being released upon the reaction with an aromatic amine developing agent; B represents a hydrogen atom, an aliphatic group, an aromatic group, a heterocyclic group, an acyl group or a sulfonyl group; Y represents a group capable of accelerating the addition of an aromatic amine developing agent to the compound represented by the general formula (FII); or $R_1$ and X, or Y and $R_2$ or B may combine with each other to form a cyclic structure.

A substitution reaction and an addition reaction are typical reactions for forming a chemical bond with the remaining aromatic amine developing agent.

Specific preferred examples of the compounds represented by formulae (FI) or (FII) are described, for example, in JP-A-63-158545, JP-A-62-283338, European Patent (OPI) Nos. 298,321 and 277,589.

On the other hand, of the Compounds (G) those more preferred are represented by the following general formula (GI):

$$R-Z \qquad \text{(GI)}$$

wherein R represents an aliphatic group, an aromatic group or a heterocyclic group; and Z represents a nucleophilic group or a group capable of being decomposed in the photographic material to release a nucleophilic group.

Of the compounds represented by the general formula (GI), those wherein Z is a group having a Pearson's nucleophilic $^nCH_3I$ value of at least 5 (R. G. Pearson et al., *J. Am. Chem. Soc.*, Vol. 90, page 319 (1968)) or a group derived therefrom are preferred.

Specific preferred example of the compounds represented by the general formula (GI) are described, for example, in European Patent (OPI) No. 255,722, JP-A-62-143048, JP-A-62-229145, Japanese Patent Application No. 63-136724 and JP-A-1-57259, European Patent (OPI) Nos. 298,321 and 277,589.

Further combinations of Compound (G) and Compound (F) are described in detail in European Patent (OPI) No. 277,589.

The photographic light-sensitive material according to the present invention may contain water-soluble dyes or dyes which become water-soluble at the time of photographic processing as filter dyes or for irradiation or halation prevention or other various purposes in the hydrophilic colloid layers. Examples of such dyes include oxonol dyes, hemioxonol dyes, styryl dyes, merocyanine dyes, cyanine dyes, and azo dyes. Of these dyes, oxonol dyes, hemioxonol dyes, and merocyanine dyes are most useful.

As binders or protect colloids which can be used for the emulsion layers of the color photographic light-sensitive material according to the present invention, gelatin is preferably used, but other hydrophilic colloids can be used alone or together with gelatin.

Examples of hydrophilic colloids (hydrophilic polymer) other than gelatin which can be used in the present invention include gelatin derivatives, graft polymers of gelatin with other high molecular weight compounds, proteins such as albumin and casein, cellulose derivatives such as hydroxyethyl cellulose, hydroxypropyl cellulose, carboxymethyl cellulose and cellulose sulfuric ester, saccharide derivatives such as sodium alginate, pyrodextran and starch derivatives, and synthetic hydrophilic high molecular weight materials comprising homopolymers and copolymers comprising monomers thereof, such as polyvinyl alcohol, polyvinyl alcohol partial acetal, polyvinyl alcohol modified by anionic and cationic compounds, poly-N-vinylpyrrolidone, polyacrylic acid and neutralization products thereof, polymethacrylic acid and neutralization products thereof, polyacrylamide, polyvinylimidazole, and polyvinyl pyrazole.

Gelatin-containing hydrophilic polymers can be properly crosslinked before use to increase initial swelling.

The total amount of hydrophilic colloids to be incorporated in the light-sensitive material preferably ranges from 2.0 to 8.0 g/m$^2$, more preferably, 3.5 to 6.5 g/m$^2$. If the value exceeds this range, it retards initial development. On the other hand, if the value falls below the range, it adversely affects the physical properties of the film upon swelling.

Any known film hardeners can be used singly or in admixture. Examples of film hardeners which can be used in the present invention include chromium salts (e.g., chromium alum and chromium acetate), aldehydes (e.g., formaldehyde, glyoxal and glutaraldehyde), N-methylol compounds (e.g., dimethylol urea and methylol dimethylhydantoin), dioxane derivatives (e.g., 2,3-dihydroxydioxane), active vinyl compounds (e.g., 1,3,5-triacryloyl-hexahydro-2-triazine and 1,3-vinylsulfonyl-2-propanol), active halogen compounds (e.g., 2,4-dichloro-6-hydroxy-3-triazine), and mucohalogenic acids (e.g., mucochloric acid, mucophenoxychloric acid).

Particularly preferred among these film hardeners are aldehyde compounds such as formaldehyde and glyoxal, S-triazine compounds such as 2-hydroxy-4,6-dichlorotriazine sodium salt, and vinylsulfonic compounds.

The amount of the film hardener to be used depends on the presence of a film hardening accelerator or inhibitor, and preferably ranges from $1\times10^{-6}$ to $1\times10^{-2}$ mol/g.gelatin, more preferably $5\times10^{-5}$ to $5\times10^{-3}$ mol/g.gelatin.

Typical Examples of Film Hardeners

HCHO 1)

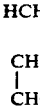
2)

$CH_3CHO$ 3)

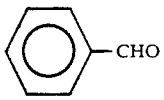
4)

$OHC{+}CH_2{\rightarrow}_3CHO$ 5)

$ClCH_2CONHCOCH_2Cl$ 6)

$ClCH_2COOCH_2CH_2OOCCH_2Cl$ 7)

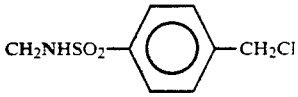
8)

$CH_3COCl$ 9)

$CH_3COCH_2Cl$ 10)

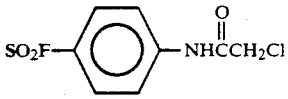
11)

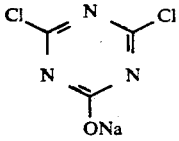
12)

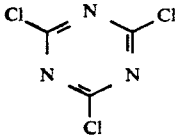
13)

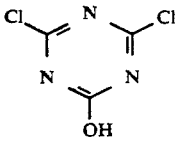
14)

-continued

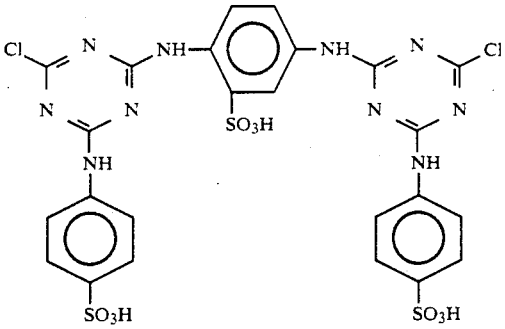
15)

$CH_2{=}CHSO_2(CH_2)_3SO_2CH{=}CH_2$ 16)

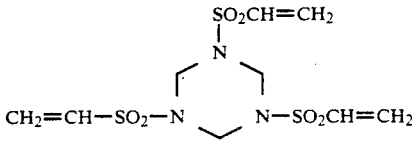
17)

$C(CH_2SO_2CH{=}CH_2)_4$ 18)

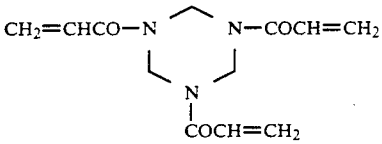
19)

$CH_2{=}CHCOOCOCH{=}CH_2$ 20)

$CH_2{=}CH{-}O{-}CH{=}CH_2$ 21)

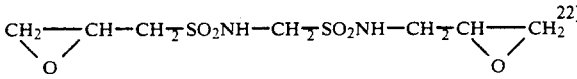
22)

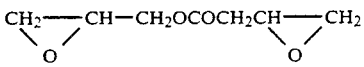
23)

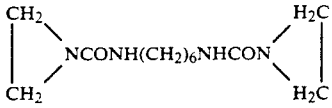
24)

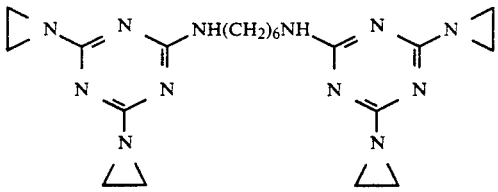
25)

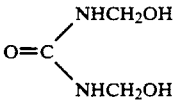
26)

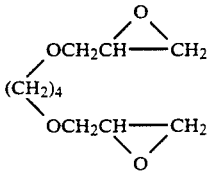
27)

$(CH_2{=}CHSO_2.CH_2CONHCH_2{\rightarrow}_2$ 28)

These film hardeners may be used in combination with a film hardening aid to harden the hydrophilic colloid. Examples of such a film hardening aid include hydrogen bond breaking agents such as thiourea and urea, and aromatic hydrocarbon containing hydroxyl groups such as hydroquinone. Only the layer to which a hardener is contained can be hardened by using a polymerized hardener.

As the support those supports conventionally employed in photographic light-sensitive materials, for example, transparent films such as cellulose nitrate films and polyethylene terephthalate films, or reflective supports can be used. For the purpose of the present invention, reflective supports are preferably employed.

The term "reflective support" refers to those supports having an increased reflection property for the purpose of rendering dye images formed in the silver halide emulsion layer clear. Examples of reflective supports include supports having coated thereon a hydrophobic resin containing a light reflective substance such as titanium oxide, zinc oxide, calcium carbonate, or calcium sulfate dispersed therein and supports composed of a hydrophobic resin containing a light reflective substance dispersed therein. More specifically, they include baryta coated paper; polyethylene coated paper; polypropylene type synthetic paper; transparent supports, for example, a glass plate, a polyester film such as a polyethylene terephthalate film, a cellulose triacetate film or a cellulose nitrate film, a polyamide film, a polycarbonate film, a polystyrene film, or a vinyl chloride resin, having a reflective layer or having incorporated therein a reflective substance.

Other examples of reflective support which can be used are supports having a metal surface of mirror reflectivity or secondary diffuse reflectivity. The metal surface preferably has a spectral reflectance of 0.5 or more in the visible wavelength range. The metal surface is preferably produced by roughening or imparting diffusion reflectivity using metal powders. Suitable examples of metals include aluminum, tin, silver, magnesium or an alloy thereof. The metal surface includes a metal plate, a metal foil or a metal thin layer obtained by rolling, vacuum evaporation or plating. Among them, a metal surface obtained by vacuum evaporation of metal on other substrate is preferably employed.

On the metal surface it is preferred to provide a water-proof resin layer, particularly a thermoplastic resin layer. On the opposite side of the support to the metal surface, an antistatic layer is preferably provided. Details of these supports are described, for example, in JP-A-61-210346, JP-A-63 24247, JP-A-63-24251 and JP-A-63-24255.

A suitable support can be appropriately selected depending on the purpose of use.

As the light reflective substance, white pigments thoroughly kneaded in the presence of a surface active agent are employed, and pigments the surface of which was treated with a divalent, trivalent or tetravalent alcohol are preferably used.

The occupied area ratio (%) per a definite unit area of fine white pigment particles can be determined in the following typical manner. Specifically, the area observed is divided into the unit area of 6 $\mu m \times 6$ $\mu m$ adjacent to each other, and the occupied area ratio (Ri) (%) of the fine particle projected on the unit area is measured. The coefficient of variation of the occupied area ratio (%) can be obtained by a ratio of S/R wherein S is a standard deviation of Ri and R is an average value of Ri. A number (n) of the unit area subject is preferably 6 or more. Thus, the coefficient of variation (S/R) is obtained by the following equation:

$$\sqrt{\frac{\sum_{i=1}^{n}(Ri-R)^2}{n-1}} \Big/ \frac{\sum_{i=1}^{n} Ri}{n}$$

In the present invention, the coefficient of variation of the occupied area ratio (%) of fine pigment particles is preferably not more than 0.15, particularly preferably not more than 0.12. When the value is not more than 0.08, the dispersibility of particles can be designated as substantially uniform.

The photographic material of the present invention is preferably subjected to color development, bleach-fixing, and washing with water (or stabilizing treatment). Bleaching and fixing may not be conducted in a monobath. They may be conducted separately.

The color developing solution to be used in the development of the photographic material can contain a known aromatic primary amine color developing agent. Preferred examples of such an aromatic primary amine color developing agent include p-phenylenediamine derivatives. Specific examples of such p-phenylenediamine derivatives will be set forth below, but the present invention should not be construed as being limited thereto.

D-1: N,N-diethyl-p-phenylenediamine
D-2: 2-Amino-5-diethylaminotoluene
D 3: 2-Amino-5-(N-ethyl-N-laurylamino)toluene
D-4: 4-[N-ethyl-N-(β-hydroxyethyl)amino]-aniline
D-6: 4-Amino-3-methyl-N-ethyl-N-[β-(methanesulfonamido)ethyl]aniline
D-7: N-(2-amino-5-diethylaminophenylethyl)methanesulfonamide
D-8: N,N-dimethyl-p-phenylenediamine
D-9: 4-Amino-3-methyl-N-ethyl-N-methoxyethylaniline
D-10: 4-Amino-3-methyl-N-ethyl-N-β-ethoxyethylaniline
D-11: 4-Amino-3-methyl-N-ethyl-N-β-butoxyethylaniline Particularly preferred among these p-phenylenediamine derivatives is 4-amino-3-methyl-N-ethyl-N-β-(methanesulfonamido)ethyl]aniline (D-6).

The p-phenylenediamine derivatives may be in the form of a sulfate, hydrochloride, sulfite, p-toluenesulfonate or the like. The amount of aromatic primary amine developing agent to be incorporated preferably ranges from 0.1 to 20 g, more preferably about 0.5 to 10 g, per 1 of developing solution.

In the process of the invention, a developing solution substantially free of benzyl alcohol is preferably used. The term "developing solution substantially free of benzyl alcohol" as used herein means a developing solution preferably containing 2 ml/l or less, more preferably 0.5 ml/l or less, and most preferably, no benzyl alcohol.

The developing solution to be used for high silver chloride content emulsions is preferably substantially free of sulfite ions. Sulfite ions serve as preservatives for developing agents but also dissolve silver halide and react with oxidation products of developing agents to reduce the efficiency of dye formation. Such an effect is considered to be one of the causes for the increase in the fluctuation of photographic properties involved in continuous processing. The term "developing solution substantially free of sulfite ions" as used herein means a developing solution containing $3.0\times10^{-3}$ mol/l or less, preferably no sulfite ions. In the present invention, however, an extremely small amount of sulfite ions used to inhibit the oxidation of a processing agent Kit containing concentrated developing agents which is to be diluted for use can be excluded from the calculation of the amount of sulfite ions.

Furthermore, the developing solution to be used in the present invention is preferably further substantially free of hydroxylamine. Hydroxylamine is believed to serve as a preservative for developing solution, but itself has a silver development activity which causes a fluctuation in the concentration of hydroxylamine that greatly affects the photographic properties. The term "developing solution substantially free of hydroxylamine" as used herein means a developing solution containing $5.0\times10^{-3}$ mol/l or less, and preferably no hydroxylamine.

More preferably, the developing solution to be used in the present invention contains an organic preservative in place of the above described hydroxylamine or sulfite ions. The term "organic preservative" as used herein means an organic compound which reduces the rate of deterioration of an aromatic primary amine color developing agent when incorporated in a processing solution for a color photographic light-sensitive material. That is, an organic compound which serves to inhibit the oxidation of a color developing agent by air. Examples of particularly effective organic preservatives include hydroxylamine derivatives (excluding hydroxylamine; the same hereinafter), hydroxamic acids, hydrazines, hydrazides, phenols, α-hydroxyketones, α-aminokentones, saccharides, monoamines, diamines, polyamines, quaternary ammonium salts, nitroxy radicals, alcohols, oxims, diamide compounds, and condensed ring type amines. These organic preservatives are disclosed in JP-A-63-4235, JP-A-63-30843, JP-A-63-21647, JP-A-63-44655, JP-A-63-53551, JP-A-63-43140, JP-A-63-56654, JP-A-63-58346, JP-A-63-43138, JP-A-63-146041, JP-A-63-44657, JP-A-63-44656, and JP-A-52-143020, U.S. Pat. Nos. 3,615,503, and 2,494,903, and JP-B-48-30496.

Other preservatives can be optionally incorporated in the developing solution. These include various metals such as those described in JP-A-57-44148 and JP-A-57-53749, salicylic acids such as those described in JP-A-59-180588, alkanolamines such as those described in JP-A-54-3532, polyethyleneimines such as those described in JP-A-56-94349, and aromatic polyhydroxy compounds such as those described in U.S. Pat. No. 3,746,544. In particular, alkanolamines such as triethanolamine, dialkylhydroxylamines such as diethylhydroxylamine, hydrazine derivatives or aromatic polyhydroxy compounds are preferably used.

Particularly preferred among the above mentioned organic preservatives are hydroxylamine derivatives and hydrazine derivatives (e.g., hydrazines, hydrazides). Examples of these organic preservatives are described in JP-A-1-97953, JP-A-1-186939, JP-A-1-186940, and JP-A-187557.

The above mentioned hydroxylamine derivatives or hydrazine derivatives are preferably used in combination with amines to improve the stability of the color developing solution, and hence, stability during the continuous processing.

Examples of the above mentioned amines include cyclic amines such as those described in JP-A-63-239447, amines such as those described in JP-A-63-128340, and amines such as those described in JP-A-1-186939 and JP-A-1-187557.

In the present invention, the color developing solution preferably contains chlorine ions in an amount of $3.5\times10^{-2}$ to $1.5\times10^{-1}$ mol/l, preferably $4\times10^{-2}$ to $1\times10^{-1}$ mol/l. If the concentration of chlorine ions exceeds $1.5\times10^{-1}$ mol/l, it is disadvantageous in that development is retarded, making it difficult to accomplish the object of providing a high maximum density in rapid processing. On the contrary, if the concentration of chlorine ions falls below $3.5\times10^{-2}$ mol/l, it is disadvantageous with respect to fog inhibition.

In the present invention, the color developing solution preferably contains bromine ions in an amount of $3.0\times10^{-5}$ mol/l to $1.0\times10^{-3}$ mol/l, more preferably $5.0\times10^{-5}$ mol/l to $5\times10^{-4}$ mol/l. If the bromine ion concentration exceeds $1\times10^{-3}$ mol/l, development is retarded, reducing the maximum density and the sensitivity. If the bromine ion concentration is less than $3.0\times10^{-5}$ mol/l, it is disadvantageous with respect to fog inhibition.

The chlorine and bromine ions can be directly incorporated in the developing solution or eluted from the light-sensitive material into the developing solution during development.

When these ions are directly incorporated in the color developing solution, examples of chlorine ion-donative substances include sodium chloride, potassium chloride, ammonium chloride, lithium chloride, nickel chloride, magnesium chloride, manganese chloride, calcium chloride, and cadmium chloride. Preferred among these chlorine ion-donative substances are sodium chloride, and potassium chloride.

Alternatively, chlorine ions may be supplied from a fluorescent brightening agent incorporated in the developing solution.

Examples of bromine ion-donative substances include sodium bromide, potassium bromide, ammonium bromide, lithium bromide, calcium bromide, magnesium bromide, manganese bromide, nickel bromide, cadmium bromide, cerium bromide, and thallium bromide. Preferred among these bromine ion-donative substances are potassium bromide, and sodium bromide.

If the chloride and bromine ions are eluted from the light-sensitive material during development, these ions may be supplied from the emulsion or other sources.

The color developing solution to be used in the present invention preferably has a pH value of 9 to 12, more preferably, 9 to 11.0. The color developing solution may contain other compounds known as components of developing solution.

In order to maintain the above described pH range, it is preferable to use various buffers. Examples of buffers which can be used in the present invention include carbonates, phosphates, borates, tetraborates, hydroxybenzoates, glycyl salts, N,N-dimethylglycyl salts, leucine salts, norleucine salts, guanine salts, 3,4-dihydroxyphenylaranine salts, aranine salts, aminobutyrates, 2-amino-2-methy-1,3-propanediol salts, valine salts, proline salts, trishydroxyaminomethane salts, and lysine salts. In particular, carbonates, phosphates, tetraborates, and hydroxybenzoates are advantageous in that they have excellent solubility and buffering action at a high pH (e.g., 9.0 or more), yet have no adverse effect (e.g., fog) on photographic properties even when incorporated in the color developing solution, and are inexpensive. Thus, these buffers are preferably used.

Specific examples of the buffers include sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), and potassium 5-sulfo-2-hydroxybenzoate (potassium 5-sulfosalicylate). However, the present invention should not be construed as being limited to these compounds.

The amount of buffer to be incorporated in the color developing solution is preferably 0.1 mol/l or more, more preferably, 0.1 mol/l to 0.4 mol/l.

The color developing solution may include various chelating agents as calcium or magnesium precipitation inhibitors or for the purpose of improving the stability of the color developing solution. Examples of such chelating agents include nitrilotriacetic acid, diethylenetriaminepentaacetic acid, ethylenediaminetetraacetic acid, N,N,N-trimethylenephosphonic acid, ethylenediamine-N,N,N',N'-tetramethylenesulfonic acid, transcyclohexanediaminetetraacetic acid, 1,2-diaminopropanetetraacetic acid, glycoletherdiaminetetraacetic acid, ethylenediamineorthohydroxyphenylacetic acid, 2-phosphonobutane-1,2,4-tricarboxylic acid, 1-hydroxyethylidene-1,1-diphosphonic acid, and N,N'-bis(2-hydroxybenzyl)ethylenediamine-N,N'-diacetic acid. These chelating agents ma be used in combination, if necessary.

Such a chelating agent may be incorporated in the color developing agent in such an amount that it blocks metallic ions in the color developing solution. For example, such a chelating agent can be incorporated in an amount of about 0.1 g to 10 g/l.

The color developing solution may optionally include a suitable development accelerator. Examples of such development accelerators include thioether compounds such as those disclosed in JP-B-37-16088, JP-B-37-5987, JP-B-38-7826, JP-B-44-12380, and JP-B-45-9019, and U.S. Pat. No. 3,81,247, p-phenylenediamine compounds such as those disclosed in JP-A-52-49829 and JP-A-50-15554, quaternary ammonium salts such as those disclosed in JP-A-50-137726, JP-A-56-156826, and JP-A-52-43429, and JP-B-44-30074, amine compounds such as those disclosed in U.S. Pat. Nos. 2,494,903, 3,128,182, 4,230,796, 3,253,919, 2,482,546, 2,596,926, and 3,582,346, and JP-B-41-11431, polyalkylene oxides such as those disclosed in JP-B-37-16088, JP-B-42-25201, JP-B-41-11431, and JP-B-42-23883, and U.S. Pat. Nos. 3,128,183, and 3,532,501, 1-phenyl-3-pyrazolidones, and imidazoles.

In the present invention, god inhibitors can be incorporated as necessary. Examples of fog inhibitors include halides of alkaline metals such as sodium chloride, potassium bromide, and potassium iodide, and organic fog inhibitors. Typical examples of organic fog inhibitors include nitrogen-containing heterocyclic compounds such as benzotriazole, 6-nitrobenzimidazole, 5-nitroisoindazole, 5-methylbenzotriazole, 5-nitrobenzotriazole, 5-chlorobenzoltriazole, 2-thiazolyl-benzimidazole, 2-thiazolylmethyl-benzimidazole, indazole, hydroxyazaindolidine, an adenine.

The color developing solution which can be applied to the present invention preferably contains a fluorescent brightening agent. Preferably used fluorescent brightening agents include 4,4'-diamino-2,2'-disulfostilbene compounds. The amount of the fluorescent brightening agent to be incorporated iranges from 0 to 5 g/l, preferably 0.1 to 4 g/l.

If desired, various surface active agents such as alkylsulfonic acid, arylsulfonic acid, aliphatic carboxylic acid, and aromatic carboxylic acid may be incorporated in the color developing solution.

The color developing solution is preferably used at a temperature of 20° to 50° C., preferably 30° to 45° C. the processing time is preferably 20 seconds or less, preferably, 15 seconds or less. The replenishment rate is preferably small, suitably 20 to 600 ml, preferably 50 to 300 ml, more preferably 60 ml to 200 ml, and most preferably 60 ml to 150 ml, per $m^2$ of light-sensitive material.

The desilvering which can be used will be described hereinafter. The desilvering can be accomplished by any one of bleaching-fixing, fixing-blix, bleaching-blix, and blix.

Bleaching solutions, blix solutions and fixing solutions which can be applied to the present invention will be described hereinafter. Any bleaching agent can be incorporated in the bleaching solution of blix solution. Particularly preferred examples of bleaching agents include complex salts of iron (III) with organic acids (e.g., aminopolycarboxylic acids such as ethylenediaminetetraacetic acid and diethylenetriaminepentaacetic acid, aminopolyphosphonic acid, phosphonocarboxylic acid and organic phosphonic acid), organic acids such as citric acid, tartaric acid, and malic acid, persulfates, and hydrogen peroxide.

Particularly preferred among these bleaching agents are organic complex salts of iron (III) due to rapidity of processing and preventing of environment pollution. Examples of aminopolycarboxylic acids, aminopolyphosphonic acids, organic phosphonic acids and salts thereof useful for the formation of organic complex salts of iron (III) include ethylenediaminetetraacetic acid, diethylenetriaminepentaacetic acid, 1,3-diaminopropanetetraacetic acid, propylenediaminetetraacetic acid, nitrilotriacetic acid, cyclohexanediaminetetraacetic acid, methyliminodiacetic acid, iminodiacetic acid, and glycoletherdiaminetetraacetic acid. These compounds can be used in the form of their sodium, potassium, lithium or ammonium salts. Preferred among these compounds are complex salts of iron (III) with ethylenediaminetetraacetic acid, diethylenetriaminepentaacetic acid, cyclohexanediaminetetraacetic acid, 1,3-diaminopropanetetraacetic acid, and methyliminodiacetic acid because of their high bleaching capability. These ferric complex salts may be used in the form of complex salts. Alternatively, a ferric salt such as ferric sulfate, ferric chloride, ferric nitrate, ferric ammonium sulfate and ferric phosphate may form a ferric complex salt in the solution with a chelating agent such as aminopolycarboxylic acid, aminopolyphosphonic acid and phosphonocarboxylic acid. The chelating agent may be used in excess of the stoichiometrical amount required to form a ferric complex salt. Preferred among these iron complexes are aminopolycarboxylic iron complexes. The amount of such a complex to be incorporated ranges 0.01 to 1.0 mol/l, preferably 0.05 to 0.50 mol/l.

The bleaching solution, blix solution and/or prebaths thereof may include various compounds as the bleaching accelerator. Preferred examples of bleaching agents having an excellent bleaching capability include compounds containing mercapto groups or disulfide bonds such as those described in U.S. Pat. No. 3,893,858, German Patent No. 1,290,812, JP-A-53-95630 and *Research Disclosure* No. 17129 (July 1978), thiourea compounds such as those described in JP-B-45-8506 (the term "JP-B" as used herein means an "examined Japanese patent publication"), JP-A-52-20832 and JP-A-53-32735, and U.S. Pat. No. 3,706,561, and halides such as iodide ions and bromide ions.

The bleaching solution or blix solution may further include a rehalogenizing agent such as a bromide (e.g., potassium bromide, sodium bromide and ammonium bromide), chloride (e.g., potassium chloride, sodium chloride and ammonium chloride) and iodide (e.g., ammonium iodide). The bleaching solution or blix solution may optionally include corrosion inhibitors such as one or more inorganic and organic acids having pH buffering capability or salts thereof with alkaline metal or ammonium (e.g., borax, sodium methaborate, acetic acid, sodium acetate, sodium carbonate, potassium carbonate, phosphorous acid, phosphoric acid, sodium phosphate, citric acid, sodium citrate and tartaric acid), ammonium nitrate and guanidine.

Known fixing agents can be used in the blix solution or fixing solution. Examples include thiosulfates (e.g., sodium thiosulfate and ammonium thiosulfate), thiocyanates (e.g., sodium thiocyanate and ammonium thiocyanate), thioethers compounds (e.g., ethlenebisthioglycolic acid and 3,6-dithia-1,8-octanediol) and water-soluble silver halide dissolving agents (e.g., thiourea). These fixing agents can be used singly or in admixture. A special blix solution comprising a combination of a fixing agent and a large amount of halide such as potassium iodide, as described in JP-A-55-155354, can be used. In the present invention, a thiosulfate, particularly ammonium thiosulfate is preferably used. The amount of the fixing agent to be incorporated (per l) preferably ranges from 0.3 to 2 mol, more preferably 0.5 to 1.0 mol. The blix solution or fixing solution preferably has a pH of 3 to 10, more preferably 5 to 9.

The blix solution may further include other various fluorescent brightening agents, anti-foaming agent, surface active agents, polyvinyl pyrrolidone, or organic solvents such as methanol.

The blix solution or fixing solution preferably contains as a preservative a sulfite ion-releasing compound such as a sulfite (e.g., sodium sulfite, potassium sulfite and ammonium sulfite), bisulfite (e.g., ammonium bisulfite, sodium bisulfite and potassium bisulfite), and metabisulfite (e.g., potassium metabisulfite, sodium metabisulfite, and ammonium metabisulfite). Such a sulfite ion-containing compound is preferably contained in an amount of about 0.02 to 0.50 mol/l, more preferably 0.04 to 0.40 mol/l, as calculated in terms of sulfurous ion.

A sulfite is commonly used as a preservative. However, other examples of preservatives include ascorbic acid, carbonyl-sulfurous acid addition products, and carbonyl compounds.

Furthermore, buffers, fluorescent brightening agents, chelating agents, anti-foaming agents, antifungal agents can be optionally incorporated in the blix or fixing solution.

The desilvering process such as fixing and blix will normally be followed by a rinse step and/or stabilization step.

The amount of rinsing water to be used at the rinse step can widely vary depending on the properties (e.g., the materials used such as the coupler) of the light-sensitive material, use thereof, temperature of the rinsing water, number of tanks (stages), the replenishment process (i.e., counter-flow or forward-flow), and other various conditions. Of these factors, the relationship between the number of washing tanks and the quantity of water in a multi-stage counter-flow system can be obtained according to the method described in *Journal of the Society of Motion Picture and Television Engineers,* Vol. 64, pp. 248 to 253 (May, 1955). The number of stages in the multi-stage counter-flow system is preferably from 2 to 6, more preferably 2 to 4.

According to the multi-stage counter-flow system described in the above reference, although the requisite amount of water can be greatly reduced (e.g., may be reduced to 0.5 to 1 l per $m^2$ of the photographic material), bacteria would grow due to an increase of the retention time of water in the tank, and floating masses of bacteria stick to the photographic material. In the present invention, in order to cope with this problem, the method of reducing calcium and magnesium ion concentrations described in JP-A-62-288838 can be used very effectively. Further, it is also effective to use isothiazolone compounds or thiabenzazoles such as those described in JP-A-57-8542, chloride containing bacteriazole, e.g., chlorinated sodium isocyanurate, benzotriazole, and bactericides described in Hiroshi Horiguchi, *Bokin Bobaizai no Kagaku* (1986) published by Sankyo Shuppan, *Biseibutsu no Mekkin, Sakkin Bobaigijutsu* (1982) edited by Eisei Gijutsu Kai, *Bokin Bobaizai Jiten* (1986) edited by Kogyo Gijutsu Kai and Nippon Bokin Bobai Gakkai.

The washing water may include a surface active agent as a hydro-draining agent or a chelating agent (e.g., EDTA) as a water softening agent.

The processing with a stabilizing solution may be effected following or omitting the rinse step. The stabilizing solution may include a compound capable of stabilizing images. Examples of such compounds include aldehyde compounds such as formalin, buffers for adjusting the pH value of the film to be suited for dye stabilization, and ammonium compounds. In order to inhibit the growth of bacteria in the solution, or to provide the processed light-sensitive material with an anti-fungal property, the stabilizing solution may include the various bactericides or anti-fungal agent described above.

The stabilizing solution may further include surface active agents, fluorescent brightening agents and film hardeners. In the processing, if the stabilization is effected while omitting the rinse step, any one of those known methods described in JP-A-57-8543, JP-A-58-14834, and JP-A-60-220345 can be used.

In other preferred embodiments, a chelating agent such as 1-hydroxyethylidene-1,1-diphosphonic acid and ethylenediaminetetramethylenephosphonic acid, magnesium compounds and bismuth compounds can be used.

The rinse solution can be used as the washing solution or stabilizing solution after the desilvering process.

The preferred pH at the washing step or stabilizing step is from 4 to 10, more preferred pH is from 5 to 8. The temperature of the water can be selected from broad ranges depending on the characteristics and end use of the photographic material, but usually ranges from 15° to 45° C., preferably from 20° to 40° C. The replenishment rate is preferably selected in a small range due to running cost, quantity of exhaust, and ease of handling.

In particular, the replenishment rate is preferably 0.5 to 50 times, more preferably 3 to 40 times, the quantity of the processing solution carried over from prebath per unit area of the light-sensitive material. Alternatively, the replenishment rate is 1 l or less, preferably 500 ml or less, per $m^2$ of a photographic material.

The solution used at the rinse step and/or stabilizing step can be further used at the pre-step. For example, a multi-stage counter-flow system can be used in such a manner that the overflow of the washing water is introduced into the blix bath as a prebath, and the blix bath is replenished with a concentrated solution to reduce the quantity discharged.

In the present invention, the development time required for the formation of color images is substantially within 20 seconds. The time required for transfer from one bath to the subsequent bath is preferably small.

The time required for transfer from the developing bath to the blix bath and from the blix solution to the rinse bath each is preferably one third or less, more preferably 1/5 or less of that required for passage through the former baths.

The amount of the solution carried over from each bath to the subsequent bath is preferably small to improve the stability of the processing solution, and is preferably 50 ml/$m^2$ or less, more preferably 30 ml/$m^2$ or less.

The total processing time required from the beginning of development to the end of drying in the present invention is preferably within 100 seconds, more preferably 90 seconds, most preferably 60 seconds.

The present invention will be further described in the following examples, but the present invention should not be construed as being limited thereto.

EXAMPLE 1

A multilayer color photographic paper was prepared by coating layers having the following structures on a paper support laminated with polyethylene on both sides thereof. The coating solutions were prepared as follows:

Preparation of Coating Solution for 1st Layer 19.1 g of a yellow coupler (ExY), 4.4 g of a dye image stabilizer (Cpd-1) and 0.7 g of a dye image stabilizer (Cpd-7) were dissolved in 27.2 ml of ethyl acetate and 8.2 g of a solvent (Solv-1). The solution obtained was then emulsion-dispersed in 185 ml of a 10% aqueous solution of gelatin containing 8 ml of 10% sodium dodecylbenzenesulfonate. Meanwhile, a blue-sensitive sensitizing dye as set forth below was added to a silver bromochloride emulsion. The emulsion was a 3:7 (Ag molar ratio) mixture of cubic silver chlorobromide grains having a silver bromide content of 0.2 mol % localized thereon, a mean grain size of 0.88 μm and a grain size fluctuation coefficient of 0.08 and cubic silver chlorobromide grains having a silver bromide content of 0.2% localized thereon, a mean grain size of 0.70 μm and a grain size fluctuation coefficient of 0.10. Each of blue sensitizing dyes shown below were added in amounts of $2.0\times10^{-4}$ mol and $2.5\times10^{-4}$ mol per mol of silver for large size emulsion and small size emulsion, respectively. These emulsions were then sulfur-sensitized. The above mentioned emulsion dispersion and the emulsion prepared therefrom were then mixed and dissolved to prepare a coating solution for the 1st layer having the following composition.

Coating solutions for the 2nd layer to the 7th layer were prepared in the same manner as for the 1st layer. As gelatin hardener for each layer there was used 1-oxy-3,5-dichloro-s-triazine sodium salt.

As spectral sensitizing dyes for each layer there were used the following compounds:

Blue-Sensitive Emulsion Layer

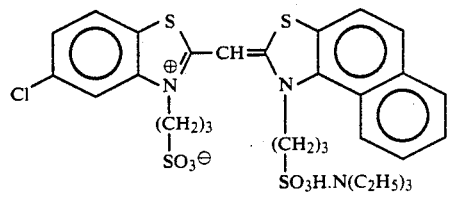

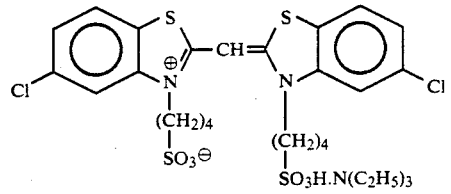

(Each dye was added in an amount of $2.0\times10^{-4}$ mol and $2.5\times10^{-4}$ mol per mol of silver halide for large size emulsion and small size emulsion, respectively)

Green-Sensitive Emulsion Layer

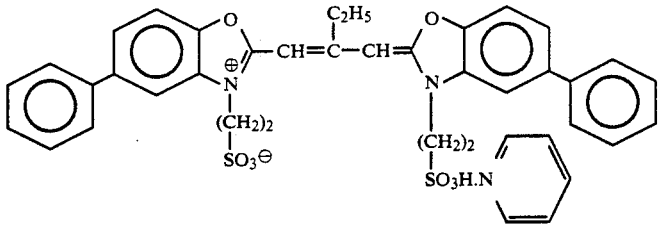

($4.0\times10^{-4}$ mol and $5.6\times10^{-4}$ mol per mol of silver halide for large size emulsion and small size emulsion, respectively)

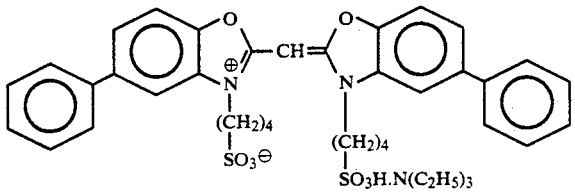

($7.0\times10^{-5}$ mol and $1.0\times10^{-5}$ mol per mol of silver halide for large size emulsion and small size emulsion, respectively)

Red-Sensitive Emulsion Layer

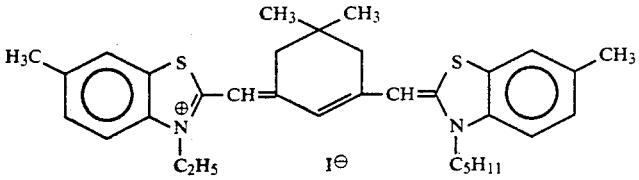

($0.9\times10^{-4}$ mol and $1.1\times10^{-4}$ mol per mol of silver halide for large size emulsion and small size emulsion, respectively)

For the red-sensitive emulsion layer, the following compound was incorporated in an amount of $2.6\times10^{-3}$ mol per mol or silver halide.

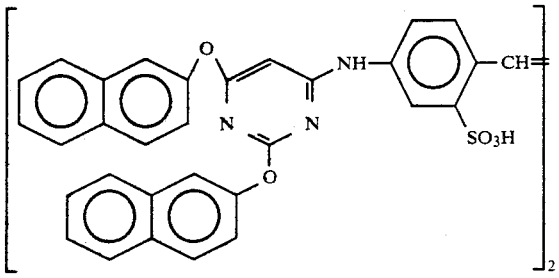

For the blue-sensitive emulsion layer, the green-sensitive emulsion layer and the red-sensitive emulsion layer, 1-(5-methylureidophenyl)-5-mercaptotetrazole was incorporated in amounts of $8.5\times10^{-5}$ mol, $7.7\times10^{-4}$ ml and $2.5\times10^{-4}$ mol per mol of silver halide, respectively.

In order to inhibit irradiation, the following dyes were incorporated in the emulsion layers.

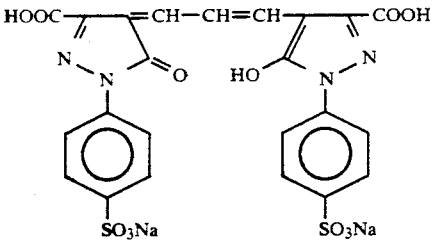

and

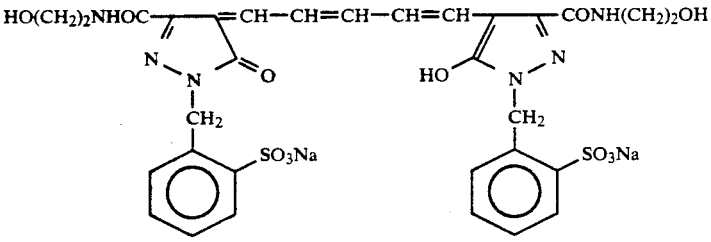

Layer Structure

The composition of each layer will be set forth below. The coated amount of each component is represented in g/m². The coated amount of silver halide emulsion is represented as calculated in terms of silver.

Support

Polyethylene-laminated (both sides) paper containing a white pigment ($TiO_2$) and a bluing dye (ultramarine) in the polyethylene layer on the side to be coated with the 1st layer

| | |
|---|---|
| 1st Layer (Blue-sensitive layer): | |
| Silver bromochloride emulsion as described above | 0.27 |
| Gelatin | 1.17 |
| Yellow coupler (ExY) | 0.68 |
| Dye image stabilizer (Cpd-1) | 0.19 |
| Solvent (Solv-1) | 0.29 |
| Dye image stabilizer (Cpd-7) | 0.06 |
| 2nd Layer (Color stain inhibiting layer): | |
| Gelatin | 0.38 |
| Color mixing inhibitor (Cpd-5) | 0.11 |
| Solvent (Solv-1) | 0.27 |
| Solvent (Solv-4) | 0.08 |
| 3rd Layer (Green-sensitive layer): | |
| Silver bromochloride emulsion (1:3 mixture (Ag molar ratio) of cubic silver bromochloride grains having AgBr content of 0.8 mol % localized thereon, mean grain size of 0.55 μm and grain size fluctuation coefficient of 0.10 and cubic silver bromochloride grains having AgBr content of 0.8 mol % localized thereon, mean grain size of 0.39 μm and grain size fluctuation coefficient of 0.08) | 0.12 |
| Gelatin | 1.25 |
| Magenta coupler (ExM) | 0.26 |
| Dye image stabilizer (Cpd-2) | 0.06 |
| Dye image stabilizer (Cpd-3) | 0.08 |
| Dye image stabilizer (Cpd-4) | 0.03 |
| Dye image stabilizer (Cpd-9) | 0.02 |
| Solvent (Solv-2) | 0.52 |
| 4th Layer (Ultraviolet-absorbing layer): | |
| Gelatin | 0.47 |
| Ultraviolet absorbent (UV-1) | 0.47 |
| Color mixing inhibitor (Cpd-5) | 0.05 |
| Solvent (Solv-5) | 0.24 |
| 5th Layer (Red-sensitive layer): | |
| Silver bromochloride emulsion (1:4 mixture (Ag molar ratio) of cubic silver bromochloride grains having AgBr content of 0.6 mol % localized thereon, mean grain size of 0.58 μm and grain size | 0.20 |

-continued

| | |
|---|---|
| fluctuation coefficient of 0.09 and cubic silver bromochloride grains having AgBr content of 0.6 mol % localized thereon, mean grain size of 0.45 μm and grain size fluctuation coefficient of 0.11) | |
| Gelatin | 0.89 |
| Cyan coupler (ExC) | 0.32 |
| Dye image stabilizer (Cpd-6) | 0.19 |
| Dye image stabilizer (Cpd-7) | 0.31 |
| Dye image stabilizer (Cpd-8) | 0.04 |
| Solvent (Solv-6) | 0.34 |
| 6th Layer (Ultraviolet absorbing layer): | |
| Gelatin | 0.24 |
| Ultraviolet absorbent (UV-1) | 0.16 |
| Color mixing inhibitor (Cpd-5) | 0.02 |
| Solvent (Solv-5) | 0.08 |
| 7th Layer (Protective layer): | |
| Gelatin | 1.25 |
| Acryl-modified copolymer of polyvinyl alcohol (modification degree: 17%) | 0.05 |
| Liquid paraffin | 0.02 |

Yellow Coupler (ExY)

1:1 (molar ratio) mixture of:

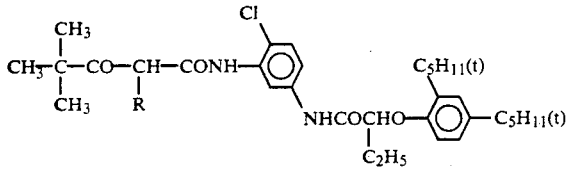

wherein R represents:

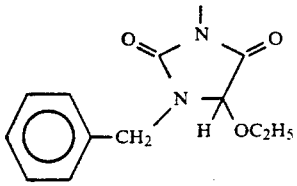

and the same compound wherein R represents

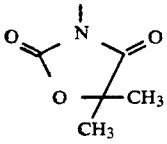

Magenta Coupler (ExM)

1:1 (molar ratio) mixture of:

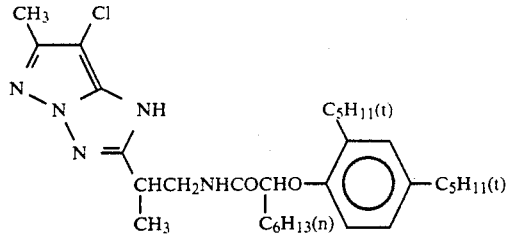

and

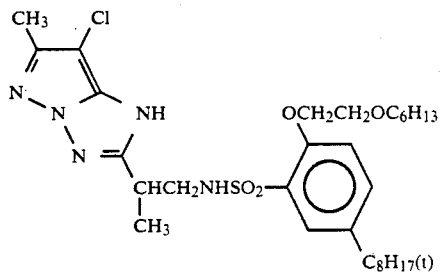

Cyan Coupler (ExC):

2:4:4 (molar ratio) mixture of:

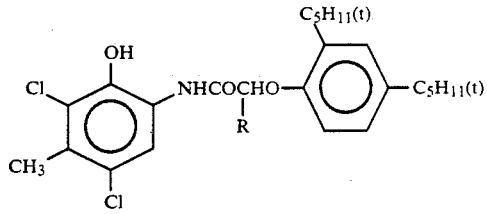

wherein R represents $C_2H_5$,
the same compound wherein R represents $C_4H_9$, and

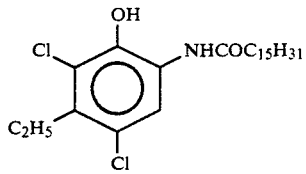

Dye Image Stabilizer (Cpd-1)

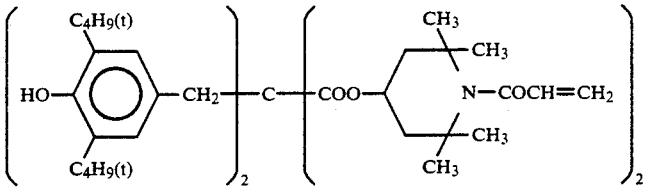

Dye Image Stabilizer (Cpd-2)
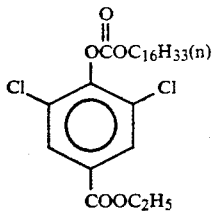
Dye Image Stabilizer (Cpd-3)
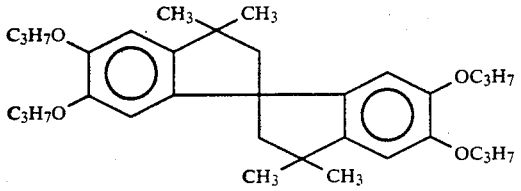
Dye Image Stabilizer (Cpd-4)
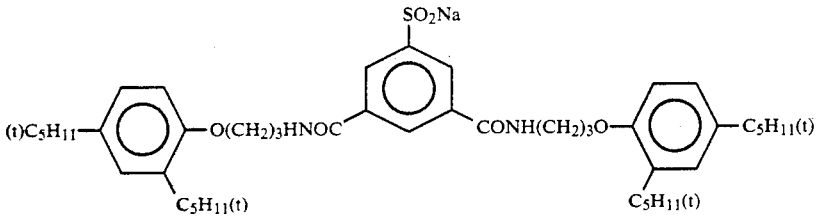
Color Mixing Inhibitor (Cpd-5)
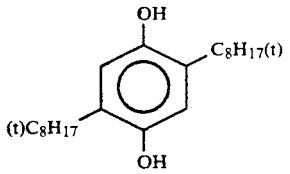
Dye Image Stabilizer (Cpd-6)
2:4:4 (weight ratio) mixture of:
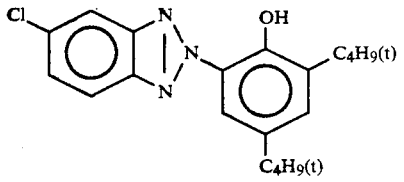
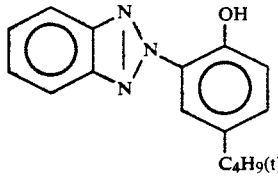
-continued
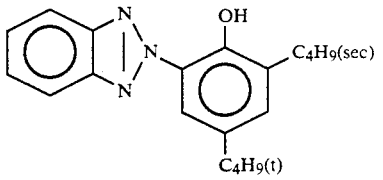
Dye Image Stabilizer (Cpd-7)
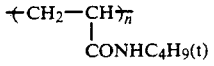
Mean molecular weight: 60,000
Dye Image Stabilizer (Cpd-8)
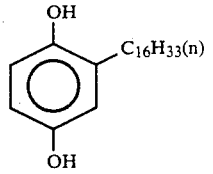
Dye Image Stabilizer (Cpd-9)
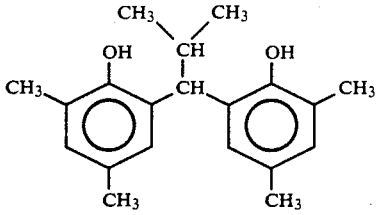
Ultraviolet Absorbent (UV-1)
4:2:4 (weight ratio) mixture of:
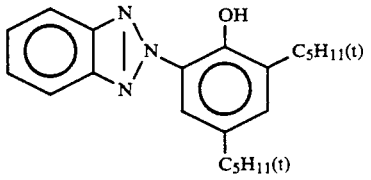

-continued

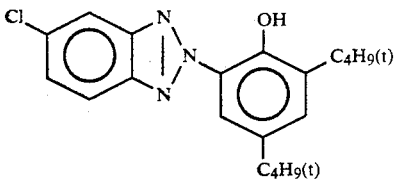

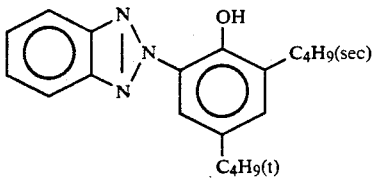

Solvent (Solv-1)

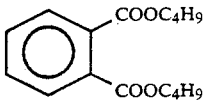

Solvent (Solv-2)

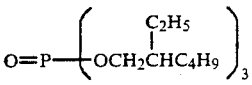

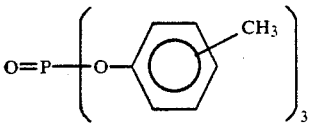

Solvent (Solv-4)

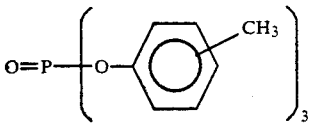

Solvent (Solv-5)

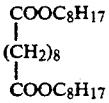

Solvent (Solv-6)

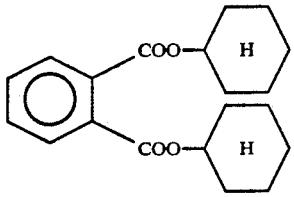

Thus, specimen 101 was prepared. In the specimen, the blue-sensitive emulsion layer and green-sensitive emulsion layer comprised 4-hydroxy-6-methyl-1,3,3a,7-tetrazaindene in amounts of $1\times10^{-4}$ mol and $2\times10^{-4}$ mole per mol of silver halide, respectively.

The specimen prepared was then subjected to gradient exposure through a three colors separation filter for sensitometry by means of a sensitometer (Fuji Photo Film Co., Ltd.'s Model FWH; color temperature of light source: 3,200° K.) in such a manner that the exposure reached 250 CMS in 0.1 second.

The exposed specimen was then subjected to continuous processing (running test) in a paper processing machine in the following steps until the replenishment reached twice the color developing solution tank volume.

| Processing Step | Temperature (°C.) | Time (sec.) | Replenishment Rate* (ml) | Tank Volume (l) |
|---|---|---|---|---|
| Color development | 43 | 20 | 161 | 17 |
| Blix | 40 to 45 | " | 215 | 17 |
| Rinse | " | " | 350 | 10 |
| Drying | 70 to 80 | 60 | | |

*Replenishment rate: per 1 $m^2$ of photographic material

The various processing solutions had the following compositions:

| Color developing solution | Tank solution | Replenisher |
|---|---|---|
| Water | 800 ml | 800 ml |
| Ethylenediamine-N,N,N',N'-tetramethylenephosphonic acid | 1.5 g | 2.0 g |
| Potassium bromide | 0.015 g | — |
| Triethanolamine | 8.0 g | 12.0 g |
| Sodium chloride | 1.4 g | — |
| Potassium carbonate | 25 g | 25 g |
| N-Ethyl-N-(β-methanesulfonamidoethyl)-3-methyl-4-aminoaniline sulfate | 5.0 g | 7.0 g |
| N,N-Bis(carboxymethyl)hydrazine | 5.5 g | 7.0 g |
| Fluorescent brightening agent (WHITEX 4B, available from Sumitomo Chemical Co., Ltd.) | 1.0 g | 2.0 g |
| Water to make | 1,000 ml | 1,000 ml |
| pH (25° C.) | 10.05 | 10.45 |

Blix Solution (The Replenisher was the same as the Tank Solution)

| | |
|---|---|
| Water | 400 ml |
| Ammonium thiosulfate (70% aqueous solution) | 100 ml |
| Sodium sulfite | 17 g |
| Ferric ammonium ethylenediaminetetraacetate | 55 g |
| Disodium ethylenediaminetetraacetate | 5 g |
| Ammonium bromide | 40 g |
| Water to make | 1,000 ml |
| pH (25° C.) | 6.0 |

Rinse Solution (The Replenisher was the same as the Tank Solution)

Ion-exchanged water (calcium and magnesium concentrations were each 3 ppm or less)

The specimen which had been subjected to color development was measured for yellow, magenta and cyan densities by means of a densitometer to obtain a characteristics curve. From these results, fog density and maximum color density were calculated. Furthermore, the difference in exposure (logarithm) required to give a density of 1.0 between at 15 second processing and at 45 second processing was calculated as sensitivity difference. The exposure difference indicates the speed of progress of development at 15 second development and thus is an important characteristic for ultra-high rapid processing light-sensitive material. The results are set forth in Example 2 along with that of Example 2.

EXAMPLE 2

Specimens 201 to 206 and Comparative Specimen 20A were prepared in the same manner as Specimen 101 of Example 1 except that alterations were made as set forth in the table below.

| Specimen No. | Reference Preparation Method | Layer | Alteration (g/m²) | |
|---|---|---|---|---|
| 20A (Comparative Example) | 101 | 2nd layer | Gelatin | 1.25 |
| | | 4th layer | | 1.42 |
| | | 6th layer | | 0.48 |
| 201 | 20A | 1st layer | Gelatin | 0.41 |
| | | 2nd layer | | 1.25 |
| | | 3rd layer | | 0.44 |
| | | 4th layer | | 1.42 |
| | | 5th layer | | 0.31 |
| | | 6th layer | | 0.48 |
| | | 7th layer | | 0.44 |
| | | | Gelatin | Poly 1 |
| 202 | 20A | 1st layer | 0.41 | 0.16 |
| | | 2nd layer | 1.25 | 0.5 |
| | | 3rd layer | 0.44 | 0.18 |
| | | 4th layer | 1.42 | 0.57 |
| | | 5th layer | 0.31 | 0.12 |
| | | 6th layer | 0.48 | 0.19 |
| | | 7th layer | 0.44 | 0.18 |
| 203 | 20A | 1st layer | Yellow coupler (ExY) | 0.48 |
| | | 3rd layer | Magenta coupler (ExM) | 0.18 |
| | | 5th layer | Cyan coupler (ExC) | 0.22 |

| Specimen No. | Reference Preparation Method | Layer | Alteration |
|---|---|---|---|
| 204 | 101 | 1st layer | Silver coated amount 0.22 |
| | | 3rd layer | Silver coated amount 0.10 |
| | | 5th layer | Silver coated amount 0.16 |
| | | | (The coated amounts of gelatin in these three layers were not changed) |
| 205 | 101 | 1st layer | Same as 5th layer of 101 |
| | | 5th layer | Same as 1st layer of 101 |

-continued

| Specimen No. | Reference Preparation Method | Layer | Gelatin | Coupler coated amount |
|---|---|---|---|---|
| 206 | 20A | 1st layer | 0.35 | 0.48 |
| | | 2nd layer | 0.38 | |
| | | 3rd layer | 0.38 | 0.18 |
| | | 4th layer | 0.47 | |
| | | 5th layer | 0.27 | 0.22 |
| | | 6th layer | 0.14 | |
| | | 7th layer | 0.38 | |

Specimen 101, Specimens 201 to 206, and Comparative Specimen 20A were then measured for the alkali-consuming amount by the method described hereinbefore. The results are set forth in Table 1.

Poly-1

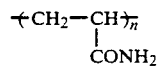

(Molecular weight: 100,000 to 200,000)

TABLE 1

| Specimen No. | Alkali-Consuming Amount (mmol/m²) |
|---|---|
| 101 | 2.6 |
| 201 | 2.4 |
| 202 | 2.4 |
| 203 | 2.5 |
| 204 | 2.6 |
| 205 | 2.6 |
| 206 | 1.5 |
| 20A | 3.1 |

The results show that Specimen 101 and Specimens 201 to 206 exhibit smaller alkali-consuming amount than Comparative Specimen 20A.

Specimens 201 to 206 and Comparative Specimen 20A were subjected to exposure and color development in the same manner as in Example 1. The results are set forth in Table 2 along with that of Specimen 101.

TABLE 2

| | | Specimen No. | | | | | | | |
|---|---|---|---|---|---|---|---|---|---|
| | | 101 | 201 | 202 | 203 | 204 | 205 | 206 | 20A |
| At beginning of continuous processing Development time (15 sec.) | | | | | | | | | |
| Fog | B | 0.08 | 0.08 | 0.09 | 0.09 | 0.08 | 0.08 | 0.09 | 0.08 |
| | G | 0.09 | 0.09 | 0.09 | 0.09 | 0.09 | 0.08 | 0.09 | 0.08 |
| | R | 0.11 | 0.11 | 0.11 | 0.10 | 0.09 | 0.09 | 0.11 | 0.10 |
| Max color density | B | 2.15 | 2.21 | 2.28 | 2.09 | 2.13 | 2.32 | 2.19 | 1.55 |
| | G | 2.54 | 2.57 | 2.57 | 2.36 | 2.33 | 2.54 | 2.39 | 2.23 |
| | R | 2.56 | 2.57 | 2.57 | 2.40 | 2.38 | 2.48 | 2.36 | 2.51 |
| Development time (45 sec.) | | | | | | | | | |
| Fog | B | 0.09 | 0.08 | 0.08 | 0.09 | 0.09 | 0.08 | 0.09 | 0.09 |
| | G | 0.10 | 0.09 | 0.08 | 0.09 | 0.08 | 0.09 | 0.08 | 0.08 |
| | R | 0.10 | 0.10 | 0.10 | 0.11 | 0.11 | 0.11 | 0.12 | 0.10 |
| Max color density | B | 2.33 | 2.36 | 2.38 | 2.21 | 2.25 | 2.39 | 2.27 | 2.34 |
| | G | 2.56 | 2.60 | 2.61 | 2.38 | 2.37 | 2.56 | 2.41 | 2.55 |
| | R | 2.58 | 2.58 | 2.59 | 2.42 | 2.40 | 2.52 | 2.36 | 2.54 |
| At beginning of continuous processing | | | | | | | | | |
| Sensitivity difference between 45 sec. deve- | B | 0.21 | 0.14 | 0.09 | 0.18 | 0.15 | 0.12 | 0.04 | 1.28 |
| | G | 0.11 | 0.10 | 0.08 | 0.09 | 0.09 | 0.11 | 0.03 | 1.27 |

TABLE 2-continued

| | | Specimen No. | | | | | | | |
|---|---|---|---|---|---|---|---|---|---|
| | | 101 | 201 | 202 | 203 | 204 | 205 | 206 | 20A |
| lopment and 15 sec. development | R | 0.08 | 0.08 | 0.07 | 0.08 | 0.06 | 0.10 | 0.10 | 0.08 |
| At end of continuous processing Development time (15 sec.) | | | | | | | | | |
| Fog | B | 0.10 | 0.10 | 0.11 | 0.10 | 0.11 | 0.11 | 0.12 | 0.21 |
| | G | 0.10 | 0.10 | 0.10 | 0.10 | 0.10 | 0.11 | 0.11 | 0.14 |
| | R | 0.11 | 0.12 | 0.11 | 0.10 | 0.11 | 0.10 | 0.12 | 0.16 |
| Max color density | B | 2.15 | 2.19 | 2.23 | 2.00 | 2.05 | 2.27 | 2.22 | 1.44 |
| | G | 2.47 | 2.47 | 2.50 | 2.25 | 2.24 | 2.48 | 2.36 | 2.08 |
| | R | 2.47 | 2.51 | 2.50 | 2.35 | 2.29 | 2.48 | 2.34 | 2.41 |
| At end of continuous processing Development time (45 sec.) | | | | | | | | | |
| Fog | B | 0.10 | 0.11 | 0.11 | 0.11 | 0.10 | 0.10 | 0.13 | 0.24 |
| | G | 0.10 | 0.10 | 0.10 | 0.10 | 0.11 | 0.11 | 0.11 | 0.16 |
| | R | 0.11 | 0.12 | 0.10 | 0.11 | 0.11 | 0.11 | 0.13 | 0.17 |
| Max color density | B | 2.29 | 2.30 | 2.33 | 2.16 | 2.20 | 2.34 | 2.24 | 2.23 |
| | G | 2.51 | 2.52 | 2.56 | 2.34 | 2.32 | 2.51 | 2.39 | 2.43 |
| | R | 2.53 | 2.57 | 2.57 | 2.40 | 2.35 | 2.48 | 2.35 | 2.45 |
| Sensitivity difference between 45 sec. development and 15 sec. development | B | 0.25 | 0.20 | 0.12 | 0.24 | 0.21 | 0.17 | 0.05 | 1.39 |
| | G | 0.14 | 0.13 | 0.10 | 0.11 | 0.11 | 0.07 | 0.04 | 0.32 |
| | R | 0.11 | 0.10 | 0.10 | 0.10 | 0.09 | 0.03 | 0.02 | 0.10 |

Table 2 shows that Specimen 101 and Specimens 201 to 206 exhibit sufficiently high maximum densities and sufficiently low minimum densities as compared to Comparative Specimen 20A, indicating that the objects of the present invention can be accomplished. It can also be appreciated that the specimens according to the invention exhibit small sensitivity differences between at 15 second development and 45 second development, showing an improved processing stability.

EXAMPLE 3

Specimens 301 and 302 were prepared in the same manner as in Specimen 201 of Example 2 except that alterations were made as set forth in the table below.

| Specimen No. | Layer | Alteration | |
|---|---|---|---|
| 301 | 1st layer | Emulsion: Pure silver chloride grain size: 0.9 μm; cubic; grain size fluctuation coefficient: 0.10) | |
| | 3rd layer | Emulsion: pure silver chloride (grain size: 0.42 μm; cubic; grain size fluctuation coefficient: 0.07) | |
| | 5th layer | Emulsion: pure silver chloride (grain size: 0.37 μm; cubic; grain size fluctuation coefficient: 0.08) | |
| (The coating amounts of these three layers were not changed.) | | | |
| 302 | 3rd layer | Silver halide emulsion* | 0.30 |
| | | Gelatin | 1.04 |
| | | Magenta coupler (ExM-2) | 0.26 |
| | | Dye image stabilizer (Cpd-3) | 0.10 |
| 302 | 3rd layer | Dye image stabilizer (Cpd-10) | 0.05 |
| | | Dye image stabilizer (Cpd-11) | 0.012 |
| | | Dye image stabilizer (Cpd-12) | 0.08 |
| | | Solvent (Solv-2) | 0.20 |
| | | Solvent (Solv-3 | 0.16 |

*Same as emulsion in the 3rd layer of Specimen 201

Specimens 301 and 302 exhibited the same alkali-consuming amount as Specimen 101 of Example 1.

Specimen 301 and 302 were then subjected to exposure and color development in the same manner as in Example 1. The results (only data obtained at the beginning of the continuous processing) are set forth in Table 3.

Magenta coupler (ExM-2)

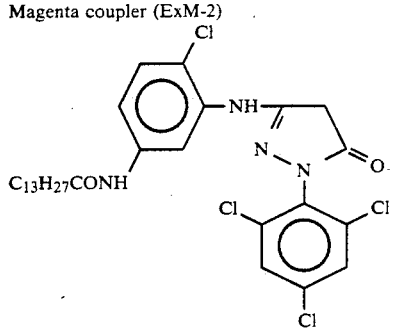

Dye image stabilizer (Cpd-10)

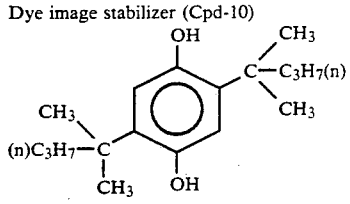

Dye image stabilizer (Cpd-11)

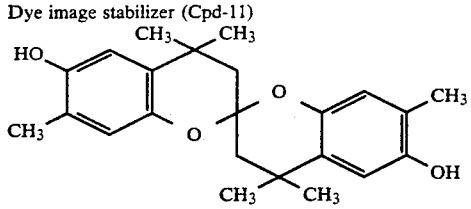

Dye image stabilizer (Cpd-12)

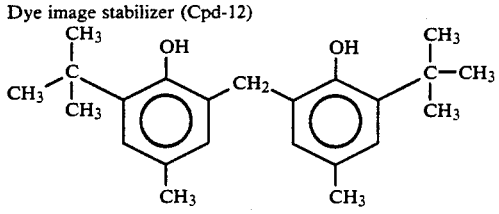

Solvent (Solv-3)

$O{=}P{\leftarrow}OC_9H_{19}(iso))_3$

Cpd-3 and Solv-2 were the same as those used in Example 1.

TABLE 3

| | | Specimen No. 301 | Specimen No. 302 |
|---|---|---|---|
| At beginning of continuous processing | | | |
| Development time (15 sec.) | | | |
| Fog | B | 0.09 | 0.09 |
| | G | 0.08 | 0.08 |
| | R | 0.09 | 0.10 |
| Max color density | B | 2.29 | 2.24 |
| | G | 2.53 | 2.50 |
| | R | 2.59 | 2.53 |
| Development time (45 sec.) | | | |
| Fog | B | 0.9 | 0.09 |
| | G | 0.09 | 0.09 |
| | R | 0.10 | 0.10 |
| Max color density | B | 2.34 | 2.33 |
| | G | 2.56 | 2.58 |
| | R | 2.58 | 2.56 |
| Sensitivity difference between 45 sec. development and 15 sec. development | B | 0.07 | 0.14 |
| | G | 0.10 | 0.10 |
| | R | 0.07 | 0.08 |

Table 3 shows that Specimens 301 and 302 develop colors much faster than Comparative Specimen 20A (see Table 2).

EXAMPLE 4

Processed Specimens 401 to 403 were prepared using the same specimens as used in Examples 1 to 2 in the same manner as in Example 1 except that alterations were made in the processing as set forth in the table below.

TABLE 4-continued

| | | Specimen No. 401 | Specimen No. 402 | Specimen No. 403 |
|---|---|---|---|---|
| Max color density | B | 2.36 | 2.34 | 2.38 |
| | G | 2.52 | 2.51 | 2.52 |
| | R | 2.56 | 2.52 | 2.55 |
| Development time (45 sec.) | | | | |
| Fog | B | 0.09 | 0.09 | 0.09 |
| | G | 0.09 | 0.10 | 0.08 |
| | R | 0.10 | 0.11 | 0.10 |
| Max color density | B | 2.41 | 2.42 | 2.40 |
| | G | 2.57 | 2.58 | 2.56 |
| | R | 2.59 | 2.55 | 2.57 |
| Sensitivity difference between 45 sec. development and 15 sec. development | B | 0.09 | 0.08 | 0.07 |
| | G | 0.04 | 0.05 | 0.05 |
| | R | 0.03 | 0.03 | 0.04 |

Table 4 shows that the specimens according to the invention are capable of being developed within 20 seconds, even if the developing agent is altered, and also exhibit excellent stability in the processing.

Specimen 101 was then processed in the same manner as Specimen 401 except that the development was effected in 10 seconds. The results show that the specimen exhibits a high maximum density and a low minimum density, accomplishing the objects of the present invention.

EXAMPLE 5

Specimens 501, 502, 503, 504, 505, 506, 50A, 50B, 50C, and 50D were prepared in The same manner as in Specimen 101 of Example 1 except that changes were made as set forth in Table 5, respectively.

| Processed Specimen | Reference Specimen | Alteration in Processing | Tank Solution | Replenisher |
|---|---|---|---|---|
| 401 | 101 | (1) 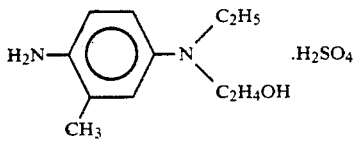  [used instead of 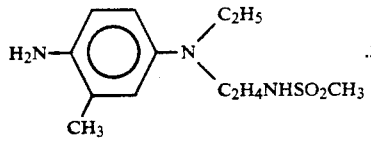  ] (2) Color development and blix were effected at a temperature of 35° C. | 6.7 g | 7.8 g |
| 402 | 201 | Same as (1) and (2) | | |
| 403 | 203 | Same as (1) and (2) | | |

Processed Specimens 401 to 403 were then measured in the same manner as in Example 1. The results are set forth in Table 4.

TABLE 4

| | | Specimen No. 401 | Specimen No. 402 | Specimen No. 403 |
|---|---|---|---|---|
| At beginning of continuous processing | | | | |
| Development time (15 sec.) | | | | |
| Fog | B | 0.09 | 0.09 | 0.09 |
| | G | 0.09 | 0.10 | 0.08 |
| | R | 0.10 | 0.10 | 0.10 |

TABLE 5

| Specimen No. | Reference Specimen | Layer | Alteration |
|---|---|---|---|
| 501 | 20A | 1st layer | Gelatin: 0.75 g/m$^2$ |
| | | 2nd layer | Gelatin: 0.81 g/m$^2$ |
| | | 3rd layer | Gelatin: 0.81 g/m$^2$ |
| | | 4th layer | Gelatin: 0.63 g/m$^2$ Polyacrylamide (average molecular weight: 100,000): 0.28 g/m$^2$ |
| | | 5th layer | Gelatin: 0.58 g/m$^2$ |

TABLE 5-continued

| Specimen No. | Reference Specimen | Layer | Alteration |
|---|---|---|---|
| | | 6th layer | Gelatin: 0.40 g/m$^2$ |
| | | 7th layer | Gelatin: 0.56 g/m$^2$<br>Poly-2*: 0.45 g/m$^2$ |
| 502 | 501 | 4th layer | Polyacrylamide: 0.17 g/m$^2$ |
| 503 | 501 | 4th layer | Polyacrylamide: 0.20 g/m$^2$ |
| 504 | 501 | 4th layer | Polyvinyl alcohol (PVA-205, available from Kuraray Co., Ltd.): 0.28 g/m$^2$ |
| 505 | 501 | 4th layer | Polydextran (molecular weight: approx. 200,000): 0.28 g/m$^2$ |
| 506 | 501 | 2nd layer | Gelatin: 0.63 g/m$^2$<br>Polyacrylamide: 0.25 g/m$^2$ |
| 50A (comparative) | 501 | 4th layer | Gelatin: 0.63 g/m$^2$ |
| 50B | 501 | 4th layer | Gelatin: 0.50 g/m$^2$<br>Polyacrylamide: 0.25 g/m$^2$ |
| 50C | 501 | 4th layer | Gelatin: 0.50 g/m$^2$<br>Polyacrylamide: 0.60 g/m$^2$ |
| 50D | 501 | 4th layer | Gelatin: 1.30 g/m$^2$ |

*Poly-2 $\left(CH_2-\underset{\underset{OH}{|}}{CH}\right)_{60}\left(CH_2-\underset{\underset{COONa}{|}}{CH}\right)_{40}$ (Suffixes of parenthesis show molar ratio)

Viscosity: approx. 1,000 Cp (as determined in the for of 50% aqueous solution at 28° C. by means of a B-type viscometer (6 r.p.m.)

Specimens 501 to 506 and 50A all exhibited an alkali-consuming amount of 2.1 mmol/m$^2$. Specimens 50B and C exhibited an alkali-consuming amount of 1.9 mmol/m$^2$. Specimen 50D exhibited an alkali-consuming amount of 2.7 mmol/m$^2$.

These specimens were then subjected to exposure and color development in the same manner as in Example 1. The results of maximum color density at 15-second and 45-second exposure are set forth in Table 6.

TABLE 6

| | | Specimen | | | | | |
|---|---|---|---|---|---|---|---|
| | | 501 | 502 | 503 | 504 | 505 | 506 |
| At the beginning of continuous processing 15-second development | | | | | | | |
| Max. color density | B | 2.15 | 2.18 | 2.20 | 2.12 | 2.19 | 2.25 |
| | G | 2.47 | 2.44 | 2.46 | 2.45 | 2.43 | 2.48 |
| | R | 2.51 | 2.52 | 2.51 | 2.51 | 2.44 | 2.51 |
| 45-second development | | | | | | | |
| Max. color density | B | 2.23 | 2.24 | 2.21 | 2.18 | 2.24 | 2.27 |
| | G | 2.48 | 2.46 | 2.48 | 2.48 | 2.47 | 2.48 |
| | R | 2.53 | 2.54 | 2.53 | 2.54 | 2.51 | 2.53 |
| At the end of continuous processing 15-second development | | | | | | | |
| Max. color density | B | 2.14 | 2.19 | 2.20 | 2.17 | 2.16 | 2.23 |
| | G | 2.45 | 2.43 | 2.45 | 2.43 | 2.41 | 2.47 |
| | R | 2.49 | 2.51 | 2.52 | 2.49 | 2.47 | 2.52 |
| 45-second development | | | | | | | |
| Max. color density | B | 2.22 | 2.27 | 2.28 | 2.23 | 2.21 | 2.24 |
| | G | 2.49 | 2.47 | 2.46 | 2.43 | 2.41 | 2.48 |
| | R | 2.55 | 2.55 | 2.53 | 2.50 | 2.49 | 2.53 |

Table 7 shows the green density of the portion at which the red density reached 2.0 at the cyan-colored portion (45-second processed specimens).

TABLE 7

| | Specimen | | | | | | | |
|---|---|---|---|---|---|---|---|---|
| | 20A | 50A | 501 | 502 | 503 | 504 | 505 | 506 |
| Green density | 0.62 | 0.69 | 0.62 | 0.62 | 0.63 | 0.62 | 0.62 | 0.63 |

Table 6 shows that the present specimens can exhibit a density high enough to form sufficient images even in a short period of time. Table 7 shows that the addition of the hydrohilic polymer eliminates color mixing.

Specimens 501, 50B, 50C and 50D were subjected to exposure and color development in the same manner as in Example 1. Table 8 shows the color density of these specimens at the end of the continuous processing and the green density of the portion at which the red density reached 2.0 at the cyan-colored portion.

TABLE 8

| | | Specimen | | | |
|---|---|---|---|---|---|
| | | 501 | 50B | 50C | 50D |
| At the end of continuous processing 15-second development | | | | | |
| Max. color density | B | 2.14 | 2.16 | 2.01 | 1.95 |
| | G | 2.45 | 2.43 | 2.35 | 2.32 |
| | R | 2.49 | 2.51 | 2.50 | 2.47 |
| 45-second development | | | | | |
| Max. color density | B | 2.22 | 2.22 | 2.28 | 2.27 |
| | G | 2.49 | 2.49 | 2.46 | 2.49 |
| | R | 2.55 | 2.54 | 2.51 | 2.49 |
| Green density of cyan-colored portion (density: 2.0) | | 0.62 | 0.71 | 0.65 | 0.61 |

Table 8 shows that Specimens 50B and 50C exhibit much color mixing. Specimen 50C shows some improvement in color mixing but is slow in the formation of images. It is also shown that Specimen 50d is excellent in inhibition of color mising but is slow in the formation of images.

According on the present invention a color photograph with high quality can be obtained.

While the invention has been described in detail and with reference to specific embodiments thereof, it will be apparent to one skilled in the art that various changes and modifications can be made therein without departing from the spirit and scope thereof.

What is claimed is:

1. A color photographic light-sensitive material capable of being processed at an ultrahigh speed, which comprises at least two light-sensitive layers on at least one side of a support, wherein each layer contains a light-sensitive silver halide emulsion and a nondiffusive oil-soluble coupler capable of coupling with an oxidation product of an aromatic primary amine color developing agent to produce a dye, said light-sensitive layers having different sensitive wavelength ranges, said silver halide is silver chloride or silver chlorobromide containing at least 90 mol % of silver chloride, and the alkali-consuming amount of said light-sensitive material is not more than 2.6 mmol/m$^2$.

2. A color photographic light-sensitive material as in claim 1, wherein the alkali consuming amount is not more than 1.82 mmol/m$^2$.

3. A color photographic light-sensitive material as in claim 1, wherein the total solid content of hydrophilic colloid in the light-sensitive material is in the range of from 2.0 to 8.0 g/m$^2$.

4. A color photographic light-sensitive material as in claim 1, wherein the total solid content of hydrophilic colloid in the light-sensitive material is in the range of from 3 5 to 6.5 g/m$^2$.

5. A color photographic light-sensitive material as in claim 1, wherein the weight ratio of (high boiling point organic solvent plus other non-binding material)/gelatin solid content in a light-insensitive interlayer in said light-sensitive material is in the range of from 0.6 to 1.3 and said interlayer contains at least one hydrophilic polymer other than gelatin in an amount of 30% by weight or more based on the gelatin (solid content).

6. A color photographic light-sensitive material as in claim 5, wherein the weight ratio is from 0.8 to 1.2.

7. A color photographic light-sensitive material as in claim 5, wherein the light-insensitive material contains at least one hydrophilic colloid other than gelatin in an amount of at most 70% by weight based on the weight of gelatin (solid).

8. A color photographic light-sensitive material as in claim 1, wherein hydrophilic colloid contained in the light-sensitive material is selected from the group consisting of gelatin, gelatin derivatives, graft polymers of gelatin with other high molecular weight compounds, cellulose derivatives, saccharide derivatives and synthetic hydrophilic high molecular weight materials.

9. A color photographic light-sensitive material as in claim 1, wherein hydrophilic colloid contained in the light-sensitive material is selected from the group consisting of gelatin, a polyacrylamide, polydextran and polyvinyl alcohol.

10. A color photographic light-sensitive material as in claim 1, wherein the material contains at least a hydrophilic colloid, a coupler, a hydroquinone, a phenolic compound and a film hardening agent, and said components being selected and used in amounts such that the alkali-consuming amount of the material does not exceed 2.6 mmol/m$^2$.

11. A process for the formation of color images comprising (i) imagewise exposing a color photographic light-sensitive material and (ii) subjecting the exposed material to development for not more than 20 seconds, said color photographic light-sensitive material comprising at least two light-sensitive layers on at least one side of a support, wherein each layer contains a light-sensitive silver halide emulsion and a nondiffusive oil-soluble coupler capable of coupling with an oxidation product of an aromatic primary amine color developing agent to produce a dye, said light-sensitive layers having different sensitive wavelength ranges, said silver halide is silver chloride or silver chlorobromide containing at least 90 mol % of silver chloride, and the alkali-consuming amount of said light-sensitive material is not more than 2.6 mmol/m$^2$.

* * * * *